US006264432B1

(12) United States Patent
Kilayko et al.

(10) Patent No.: US 6,264,432 B1
(45) Date of Patent: Jul. 24, 2001

(54) METHOD AND APPARATUS FOR CONTROLLING A PUMP

(75) Inventors: Enrique L. Kilayko, Spruce Head, ME (US); Liam Ryan, Limerick (IE)

(73) Assignee: Liquid Metronics Incorporated, Acton, MA (US)

( * ) Notice: Subject to any disclaimer, the term of this patent is extended or adjusted under 35 U.S.C. 154(b) by 0 days.

(21) Appl. No.: 09/388,823

(22) Filed: Sep. 1, 1999

(51) Int. Cl.[7] ..... F04B 49/06
(52) U.S. Cl. ..... 417/44.1; 364/110
(58) Field of Search ..... 417/212, 12, 17, 417/44, 44.1, 18, 44.3, 222.1, 45; 123/504, 196; 62/160; 364/510

(56) References Cited

U.S. PATENT DOCUMENTS

| | | | | |
|---|---|---|---|---|
| 2,292,896 | | 8/1942 | Morgan | 103/113 |
| 2,675,758 | | 4/1954 | Hughes | 103/38 |
| 2,695,629 | | 11/1954 | Ribley | 137/786 |
| 3,124,111 | | 3/1964 | Fuka | 123/32 |
| 3,285,182 | | 11/1966 | Pinkerton | 103/44 |
| 3,446,241 | | 5/1969 | Skoli | 137/553 |
| 3,602,246 | | 8/1971 | Hettinger et al. | 137/270 |
| 3,610,782 | | 10/1971 | McGuire, III | 417/326 |
| 3,715,174 | | 2/1973 | Davis et al. | 417/311 |
| 3,723,840 | | 3/1973 | Opal et al. | 318/432 |
| 3,855,515 | | 12/1974 | Hutchins, Jr. | 318/685 |
| 3,966,358 | * | 6/1976 | Heimes et al. | 417/12 |
| 3,984,315 | | 10/1976 | Ernst et al. | 210/31 C |
| 4,145,161 | | 3/1979 | Skinner | 417/22 |
| 4,147,824 | | 4/1979 | Dettmann et al. | 428/65 |
| 4,150,922 | | 4/1979 | Cuúnoud et al. | 417/45 |
| 4,195,662 | | 4/1980 | Göttel | 137/554 |
| 4,273,261 | | 6/1981 | Krueger | 222/135 |
| 4,278,406 | | 7/1981 | Cooperrider | 417/199 A |
| 4,285,497 | | 8/1981 | Güttel | 251/138 |
| 4,291,358 | | 9/1981 | Dettmann et al. | 361/154 |

(List continued on next page.)

OTHER PUBLICATIONS

Product Brochure "Metering Pumps," LMI Milton Roy, Jun. 1998.

Product Brochure "Metering Pumps and Accessories" created in Oct. 1992 for Liquid Metronics Division of Milton Roy.

Product Brochure "Milton Roy Metering Pump Technology," Milton Roy, Bulletin 210, Jul. 1998.

Able et al., "Diaphragm Pumps".

ProMinent Dosiertechnik GmbH (visited Aug. 9, 1999) <http://www.prominent.de/english/index.htm>.

ProMinent® alpha Motor Driven Diaphragm Dosing Pumps (visited Aug. 9, 1999) <http://www.prominent.de/english/products/alpha.htm>.

ProMinent® beta Solenoid Diaghragm Dosing Pumps (visited Aug. 9, 1999) <http://www.prominent.de/english/products/beta.htm>.

ProMinent® gamma Solenoid Diaphragm Dosing Pumps (visited Aug. 9, 1999) <http:www.prominent.de/english/products/gamma.htm>.

ProMinent EXtronic® Dosing Pumps (visited Aug. 9, 1999) <http://www.prominent.de/english/products/extronic.htm>.

ProMinent® mikro g/5 Precision Piston Dosing Pumps (visited Aug. 9, 1999) <http://www.prominent.de/english/products/mikro.htm>.

Latest News—New gamma/L series of metering pumps (visited Aug. 12, 1999) <http://www.prominent.de/english/brandnew.htm>.

Kilayko et al., "Pump Control and Method of Operating Same," filed Oct. 12, 1998, assigned to Liquid Metronics Incorporated (common assignee).

*Primary Examiner*—Teresa Walberg
*Assistant Examiner*—Leonid Fastovsky

(57) ABSTRACT

A control for a pump detects an operational characteristic thereof and applies power to a power unit in dependence upon the detected operational characteristic to automatically and electronically control pump priming and stroke length.

47 Claims, 14 Drawing Sheets

U.S. PATENT DOCUMENTS

| | | | | |
|---|---|---|---|---|
| 4,323,333 | | 4/1982 | Apter et al. | 417/63 |
| 4,327,695 | * | 5/1982 | Schechter | 123/504 |
| 4,345,442 | * | 8/1982 | Dorman | 62/160 |
| 4,473,338 | | 9/1984 | Garmong | 417/12 |
| 4,523,902 | | 6/1985 | Wally | 417/410 |
| 4,534,539 | | 8/1985 | Dettmann | 251/65 |
| 4,534,706 | * | 8/1985 | Palm et al. | 417/17 |
| 4,578,626 | | 3/1986 | Richter | 318/338 |
| 4,599,046 | * | 7/1986 | James | 417/44 |
| 4,619,589 | | 10/1986 | Müller et al. | 417/388 |
| 4,635,621 | | 1/1987 | Atkinson | 128/66 |
| 4,661,751 | | 4/1987 | Werner | 318/332 |
| 4,718,824 | | 1/1988 | Cholet et al. | 417/14 |
| 4,744,729 | * | 5/1988 | Hasten et al. | 417/12 |
| 4,787,823 | | 11/1988 | Hultman | 417/45 |
| 4,811,624 | | 3/1989 | Fritsch | 74/571 L |
| 4,823,067 | | 4/1989 | Weber | 318/799 |
| 4,839,571 | | 6/1989 | Farnham et al. | 340/606 |
| 4,841,404 | | 6/1989 | Marshall et al. | 361/30 |
| 4,857,814 | | 8/1989 | Duncan | 318/281 |
| 4,966,528 | | 10/1990 | Henkel et al. | 417/63 |
| 4,994,984 | * | 2/1991 | Massimo | 364/510 |
| 5,013,990 | | 5/1991 | Weber | 318/814 |
| 5,015,153 | | 5/1991 | Uesugi et al. | 417/44 |
| 5,027,661 | | 7/1991 | Desaulniers et al. | 73/861 |
| 5,032,772 | | 7/1991 | Gully et al. | 318/135 |
| 5,040,567 | | 8/1991 | Nestler et al. | 137/625.44 |
| 5,054,522 | | 10/1991 | Kowanz et al. | 137/625.33 |
| 5,056,036 | * | 10/1991 | Van Bork | 364/510 |
| 5,096,643 | | 3/1992 | Kowanz et al. | 264/130 |
| 5,120,199 | | 6/1992 | Youngs et al. | 417/18 |
| 5,140,311 | | 8/1992 | Cook | 340/682 |
| 5,141,402 | | 8/1992 | Bloomquist et al. | 417/5 |
| 5,159,255 | | 10/1992 | Weber | 318/775 |
| 5,204,595 | | 4/1993 | Opal et al. | 318/430 |
| 5,249,932 | | 10/1993 | VanBork | 417/386 |
| 5,260,175 | | 11/1993 | Kowanz et al. | 430/326 |
| 5,269,659 | | 12/1993 | Hampton et al. | 417/12 |
| 5,281,100 | * | 1/1994 | Diederich | 417/18 |
| 5,372,482 | | 12/1994 | London et al. | 417/12 |
| 5,425,623 | * | 6/1995 | London et al. | 417/18 |
| 5,458,466 | * | 10/1995 | Mills | 417/12 |
| 5,520,517 | * | 5/1996 | Sipin | 417/44.3 |
| 5,526,685 | | 6/1996 | Davis | 73/262 |
| 5,543,108 | | 8/1996 | Bacher et al. | 264/553 |
| 5,545,012 | | 8/1996 | Anastos et al. | 417/44.11 |
| 5,549,456 | | 8/1996 | Burrill et al. | 417/12 |
| 5,551,664 | | 9/1996 | Boke | 251/30.03 |
| 5,563,481 | | 10/1996 | Krause | 318/254 |
| 5,641,270 | | 6/1997 | Sgourakes et al. | 417/44.2 |
| 5,647,733 | | 7/1997 | Augustyn et al. | 417/360 |
| 5,650,709 | | 7/1997 | Rotunda et al. | 318/802 |
| 5,653,422 | | 8/1997 | Pieloth et al. | 251/129.2 |
| 5,667,368 | | 9/1997 | Augustyn et al. | 417/385 |
| 5,711,346 | | 1/1998 | Pieloth et al. | 137/625.44 |
| 5,718,567 | | 2/1998 | Rapp et al. | 417/395 |
| 5,746,079 | | 5/1998 | Hettinger et al. | 72/57 |
| 5,762,097 | | 6/1998 | Hettinger et al. | 137/270 |
| 5,779,218 | | 7/1998 | Kowanz | 251/129.06 |
| 5,904,126 | * | 5/1999 | McKay et al. | 123/196 S |
| 5,944,492 | * | 8/1999 | Konishi et al. | 417/222.1 |
| 5,980,211 | * | 11/1999 | Tojo et al. | 417/45 |

* cited by examiner

METHOD AND APPARATUS FOR CONTROLLING A PUMP

TECHNICAL FIELD

The present invention relates generally to pumps, and more particularly to a method and apparatus for controlling a pump.

BACKGROUND OF THE INVENTION

Often, it is necessary in an industrial or other process to inject a measured quantity of a flowable material into a further stream of material or a vessel. Metering pumps have been developed for this purpose and may be either electromagnetically or hydraulically actuated. Conventionally, an electromagnetic metering pump utilizes a linear solenoid which is provided half-wave or full-wave rectified pulses to move a diaphragm mechanically linked to an armature of the solenoid.

FIGS. 1 and 2 illustrate a conventional control strategy for an electromagnetic metering pump 15 (shown in FIG. 3). A solenoid 16 (also shown in FIG. 3) is electrically powered at a sufficient level to provide a pumping force at maximum air gap (i.e., zero stroke) which will meet or exceed the maximum fluid force expected to be encountered. The electric power is also delivered at maximum power level at all other stroke positions.

As illustrated in FIG. 3, the stroke length of the metering pump 15 is conventionally controlled by a mechanical stroke length adjustment control 17 comprising a screw 18 and a handle 19. Typically, an operator of the pump manually sets the stroke length by turning the handle 19, thereby adjusting the screw 18 to a position corresponding to the desired stroke length.

Moreover, the metering pump is ordinarily primed by operating a priming button disposed external to the pump. To prime in this manner, the operator first manually adjusts the mechanical stroke length adjustment control 17 via the handle 19 to the position associated with a maximum stroke length and then pushes the external prime button, which in turn causes the pump to run at its maximum pumping rate.

Several problems, however, arise during the operation of the conventional metering pump. First, the heat that is generated by the electrical powering of the solenoid typically results in the need for components that can tolerate same, such as plastic and metal enclosures and other plastic and metal parts and/or larger solenoids with more copper windings. In addition, the extra forces applied to the armature in light of the maximum power that is applied result in the need for relatively heavier return springs and components to counteract residual magnetism and allow the armature to return in time for the pump diaphragm to do suction work. Still further, sound levels are increased owing to the banging of the armature at the end of the stroke when pumping against lower force levels, and further due to the striking of the armature against a stroke adjustment stop at the end of each suction stroke under the influence of the heavy return spring. Service life is typically short owing to the mechanical stresses that are encountered.

In addition, the conventional mechanical stroke length adjustment control 17 can be inaccurate owing to a lack of precision of the parts and wear.

Moreover, the priming devices present in even the most sophisticated metering pumps are not capable of automatically detecting a loss of prime. Rather, the operator must independently detect that a loss-of-prime condition has arisen. In addition, conventional metering pumps do not automatically return to the originally programmed stroke settings or pump operating conditions after priming or repriming.

SUMMARY OF THE INVENTION

In an effort to overcome these problems, a new control methodology has been implemented that automatically and electronically controls stroke length, stroke velocity and pump priming, while delivering power to the coil as a function of the position of the pump element, thereby substantially reducing the amount of wasted force and energy and the amount of heat produced.

More particularly, in accordance with one aspect of the present invention, a control for a pump having a movable pump element movable over a stroke length which is controllably variable in response to electrical power applied to a power unit comprises a sensor for detecting an operational characteristic of the pump and a circuit responsive to the sensor. The circuit modulates electrical power applied to the power unit in dependence upon the detected operational characteristic of the pump to control the stroke length of the movable pump element.

Preferably, the power unit comprises a solenoid having a coil. Also preferably, the pump element comprises an armature and the sensor comprises a position sensor for detecting the position of the armature. In addition, power is applied to the pump during a suction stroke for controlling the stroke length.

In accordance with another embodiment, the sensor comprises at least one pressure transducer which senses a pressure differential. The circuit may comprise a driver circuit that is coupled to the coil for applying electrical power thereto. A programmed processor is responsive to the sensor for controlling the driver circuit such that electrical power is delivered to the coil in dependence upon the position of the armature.

In accordance with another embodiment, the control may further comprise a keypad coupled to the circuit for inputting a pump parameter and a display also coupled to the circuit for displaying a plurality of pump parameters.

In alternative embodiments, the pump may comprise an electromagnetic metering pump or a hydraulic metering pump.

In accordance with a further aspect of the present invention, a control for an electromagnetic metering pump having a movable pump element movable over a stroke length which is controllably variable in response to electrical power applied to a solenoid comprises a position sensor for detecting a position of the movable pump element and a driver circuit responsive to the sensor and modulating electrical power applied to the solenoid. Power is applied to the solenoid during a suction stroke in dependence upon the detected position of the pump element to control the stroke length of the movable pump element.

In accordance with yet another aspect of the present invention, a method of controlling the stroke length of a pump having a coil and an armature alternately movable in suction and discharge strokes within a range of positions comprises the steps of detecting the position of the armature and providing electrical power to the coil in dependence upon the position of the armature.

In accordance with yet another aspect of the present invention, a control for a metering pump having a movable pump element movable over a stroke length which is controllably variable in response to electrical power applied to a power unit comprises a sensor for detecting an operational characteristic of the pump and a circuit responsive to the sensor. The circuit modulates electrical power applied to the power unit in dependence upon the operational characteristic of the pump element to automatically prime the pump.

In accordance with yet another aspect of the present invention, a control for a metering pump having a movable pump element movable over a stroke length which is controllably variable in response to electrical power applied to a solenoid comprises a position sensor for detecting a position of the pump element and a driver circuit responsive to the sensor. The driver circuit modulates electrical power applied to the solenoid in dependence upon the position of the pump element to automatically prime the pump. The pump element is movable in suction and discharge strokes and the circuit includes means for increasing power applied to the power unit during a suction stroke when a detected pump element velocity is greater than a certain magnitude. The circuit further includes means for reapplying power to the power unit during a subsequent discharge stroke to prime the pump.

In accordance with yet another aspect of the present invention, a method of automatically priming a pump having a coil and an armature movable within a range of positions in suction and discharge strokes comprises the steps of detecting the position of the armature and increasing electrical power applied to the coil during the suction stroke of the armature when the detected armature velocity is greater than a certain magnitude. The method further comprises the step of reapplying power to the coil during a subsequent discharge stroke to prime the pump.

In accordance with yet another aspect of the present invention, a control for a metering pump having a movable pump element which is alternately movable in suction and discharge strokes along a stroke length which is controllably variable in response to electrical power applied to the power unit comprises a sensor for detecting an operational characteristic of the pump and a circuit responsive to the sensor. The circuit modulates power applied to the power unit in dependence upon the detected operational characteristic of the pump element to control pump priming, stroke length and stroke velocity.

By electronically and automatically controlling the stroke length of the pump, the present invention eliminates the external mechanical stroke length adjustment control, thereby improving the overall accuracy of the metering pump. Furthermore, the present invention also allows for automatic priming of the metering pump. The same hardware that electronically controls the stroke length of the pump and the amount of power applied to the solenoid as a function of the position of the pump element also automatically primes the metering pump. Thus, the conventional priming button may be eliminated as is the need for an operator to detect a loss-of-prime condition and take corrective action.

DESCRIPTION OF THE PREFERRED EMBODIMENTS

Figure 1:
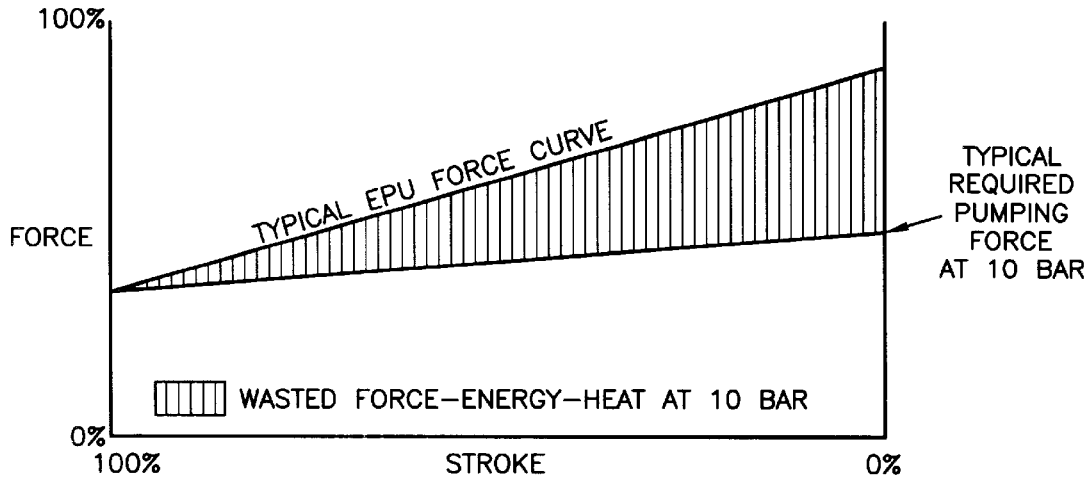
FIG. 1 Prior Art
FIGS. 1 and 2 are idealized graphs illustrating developed armature force as a function of armature position for prior art electromagnetic metering pumps.
Figure 2:
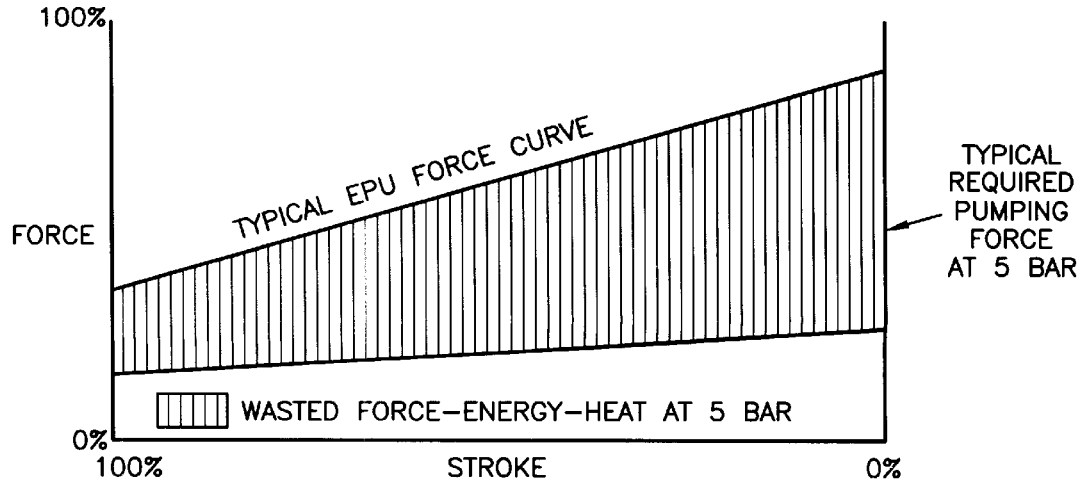
FIG. 2 Prior Art
Figure 3:
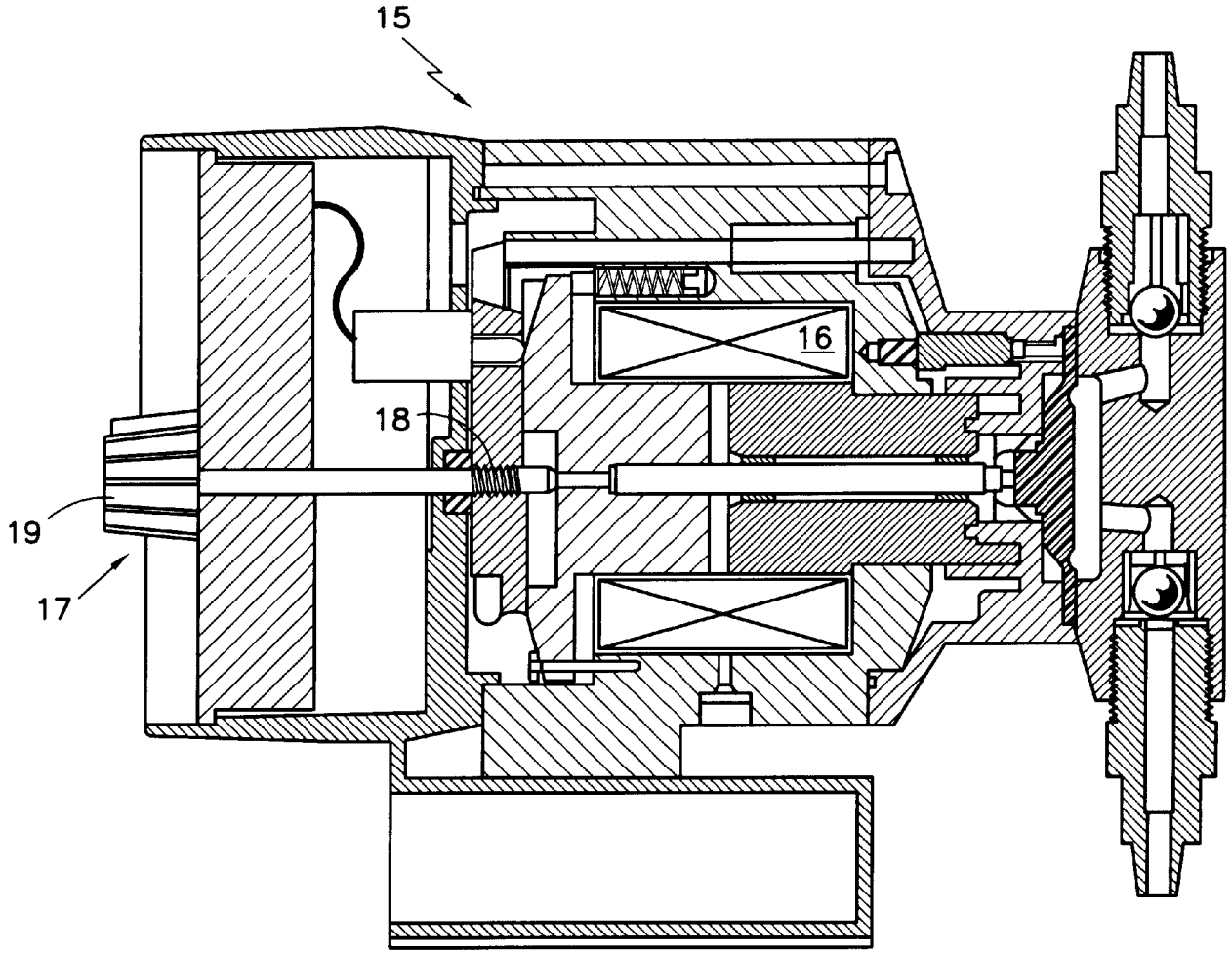
FIG. 3 is a partial sectional view of an electromagnetic metering pump having a mechanical stroke length adjustment control.
Figure 4:
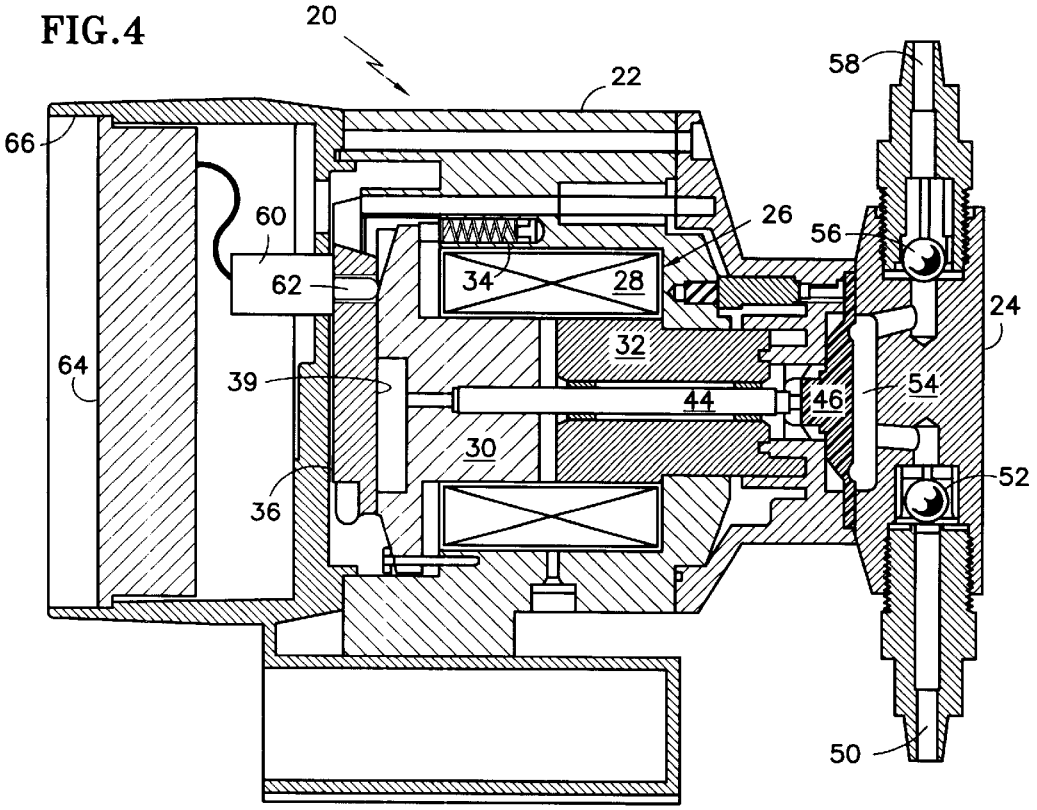
FIGS. 4 and 5 are partial sectional views of an electromagnetic metering pump that may be controlled according to the present invention.
Figure 5:
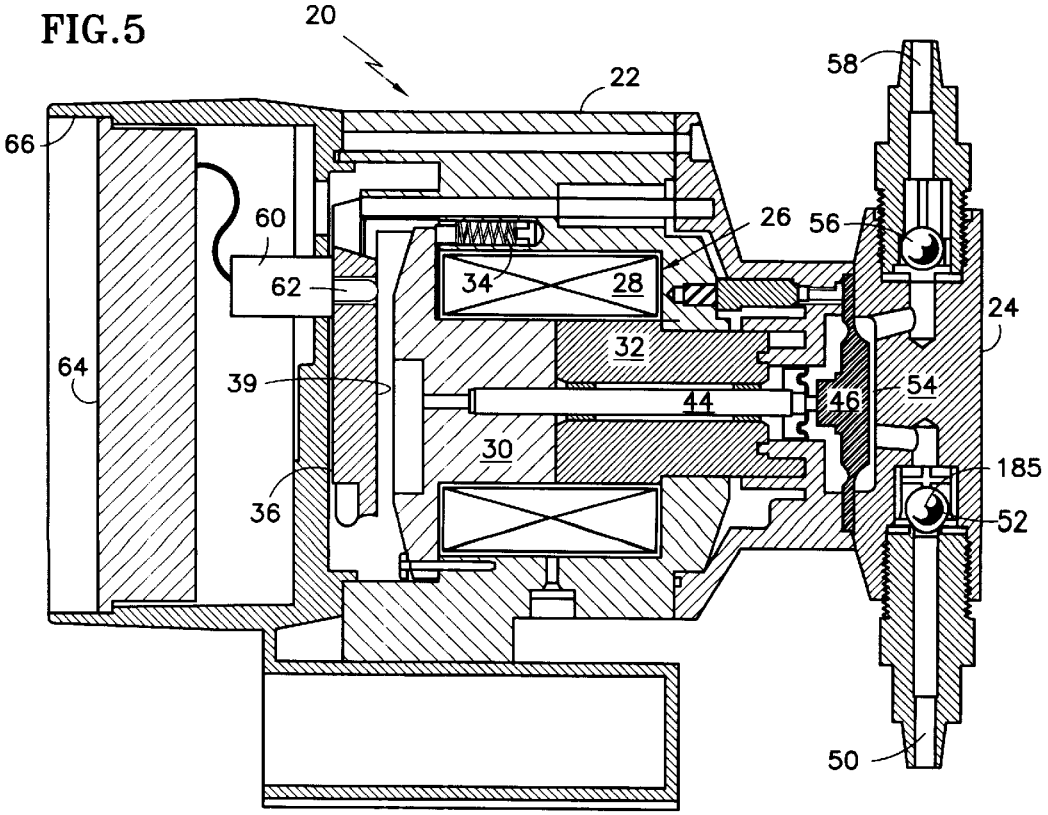

Referring now to FIGS. 4 and 5, there is illustrated an electromagnetic metering pump 20 incorporating the present invention and which is alternately movable between suction and discharge strokes. It should be noted that the present invention is useful to control other types of pumps, such as a hydraulic metering pump or any other pumping apparatus. The metering pump 20 includes a main body 22 joined to a liquid end 24. The main body 22 houses an actuator in the form of an electromagnetic power unit (EPU) 26 which may comprise a solenoid having a coil 28 and a movable armature 30. The EPU 26 further includes a pole piece 32 which, together with the coil 28 and the armature 30, form a magnetic circuit.

The armature 30 is biased to the left (as seen in FIGS. 4 and 5) by at least one, and preferably a plurality of circumferentially spaced return springs 34 such that, when no excitation is provided to the coil 28, the armature 30 rests against a mechanical stop 39.

A shaft 44 is coupled to and moves with the armature 30. The shaft 44 is in turn coupled to a pump diaphragm 46 which is sealingly engaged between the main body 22 and the liquid end 24. As the coil 28 is energized and deenergized, the armature 30, the shaft 40 and the diaphragm 46 are reciprocated between the positions shown in FIGS. 4 and 5. During a suction stroke of such reciprocation, liquid is drawn upwardly through a first fitting 50 past a first check valve 52 and enters a diaphragm recess 54. A second check valve 56 is closed during the suction stroke, as shown in FIG. 4. As shown in FIG. 5, during a discharge stroke of the reciprocation the first check valve 52 is closed and the second check valve 56 is opened thereby allowing the liquid then to travel upwardly past the second check valve 56 and a fitting 58 and outwardly of the pump 20.

A position sensor 60 is provided having a shaft 62 in contact with the armature 30 and develops a signal representative of the position of the armature 30. If desired, the position sensor 60 may be replaced by one or more transducers which develop signals representing the differential between the pressure encountered by the diaphragm 46 and the fluid pressure at the point of liquid injection from the pump. In this case, the power supplied to the coil 28 is controlled so that this pressure difference is kept low but will still finish the discharge stroke within a desired length of time.

Figure 9:
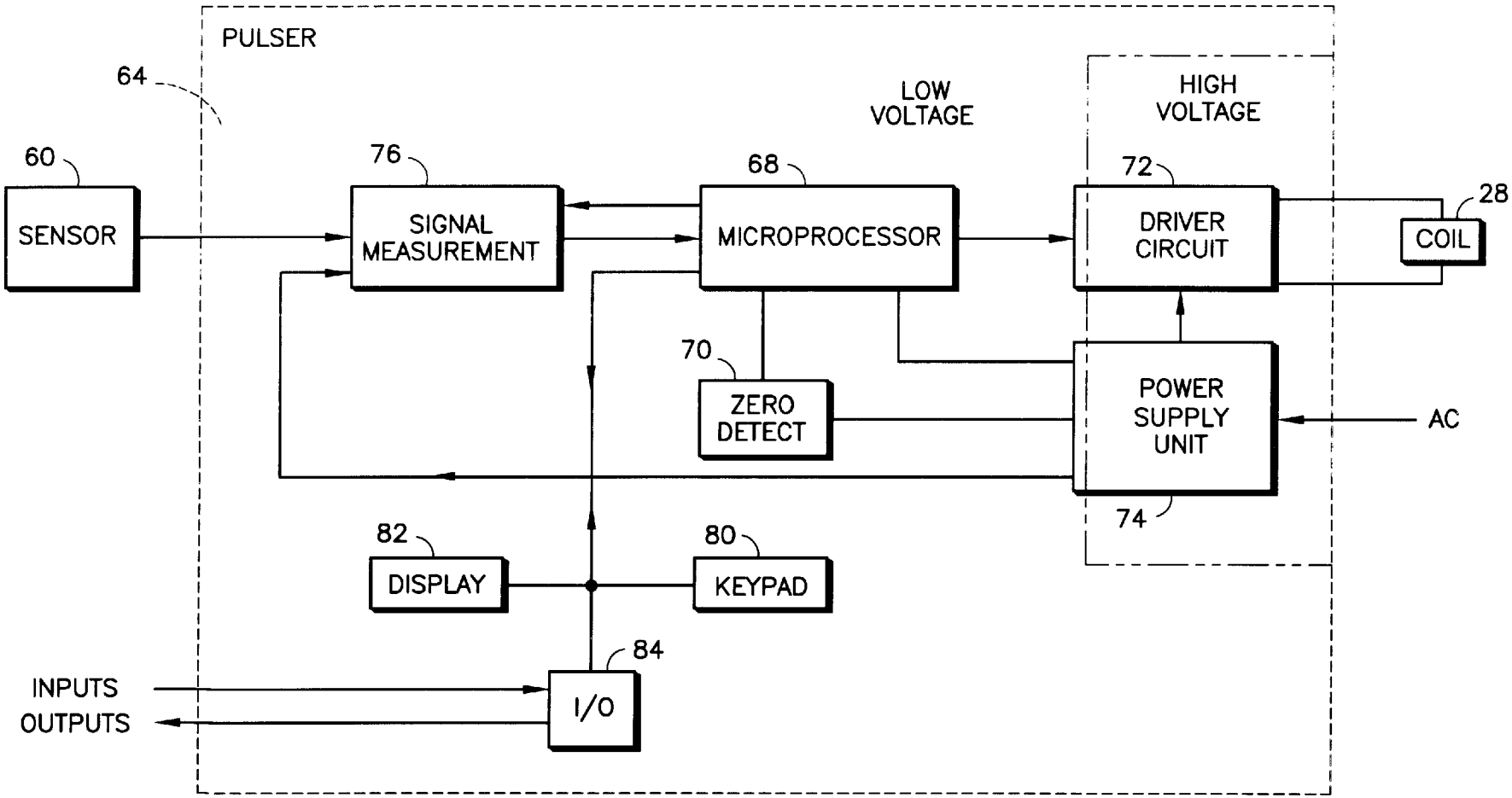
FIG. 9 is a block diagram of a pump control according to the present invention.
Figure 11:
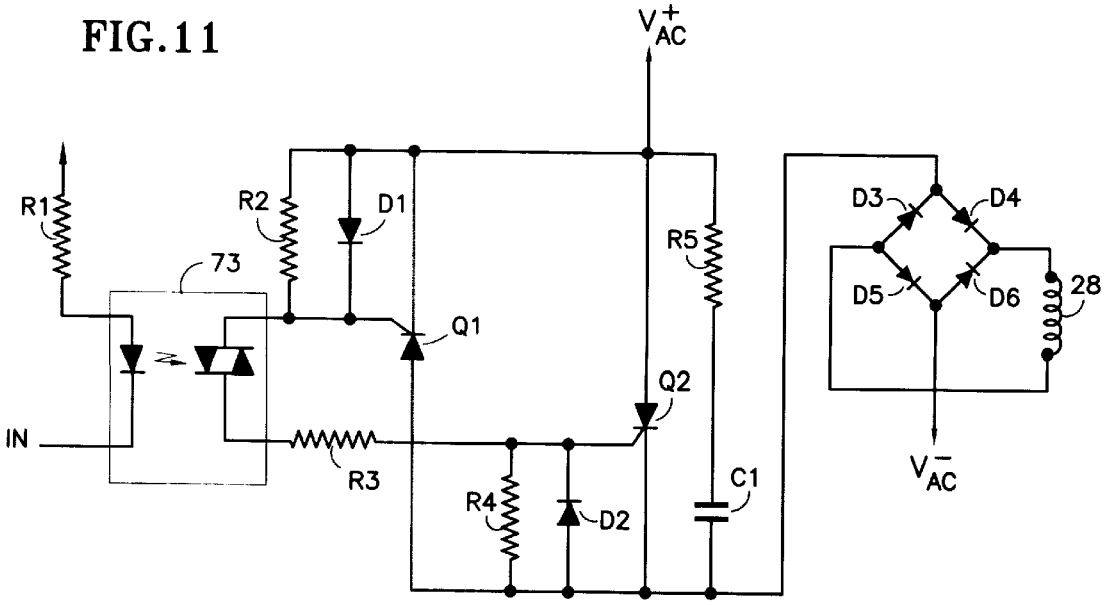
FIG. 11 is a schematic diagram of the driver circuit of FIG. 9.

A pulser circuit 64 is provided in a recess 66. As seen in FIG. 9, the pulser comprises a number of circuit components including a microprocessor 68 which is responsive to a zero detection circuit 70 and which develops signals for controlling a driver circuit 72 shown in greater detail in FIG. 11. In the preferred embodiment, the microprocessor 68 develops control signals which are supplied via an input IN of an opto-isolator 73 to cross-connected switching elements, such as SCR's Q1 and Q2 or other devices such as IGBT's, power MOSFET's or the like. Resistors R1–R5, diodes D1 and D2 and capacitor C1 provide proper biasing and filtering as needed. The SCR's Q1 and Q2 provide phase controlled power which is rectified by the full wave rectifier comprising diodes D3–D6 and supplied to the coil 28. If desired, the microprocessor 68 may instead control the driver circuit 72 to supply pulse width modulated power or true variable DC power to the coil 28.

As also shown in FIG. 9, the microprocessor 68 may be coupled to a keypad 80 and a display 82, as well as other input/output (I/O) circuits 84 as desired or required. The keypad 80 is the mechanism for setting pump control parameters, e.g., a percent stroke volume, stroke rate (strokes per minute) and/or flow rate (volume pumped per time), in any pump mode of operation. As noted in greater detail hereinafter, the microprocessor 68 calculates actual stroke length using percent stroke volume and correction factors CF1 and CF2 which correct for the nonlinear relationship between the actual volume output per stroke and actual stroke length.

The pump according to the present invention may operate in one of several modes that include a fully manual mode of operation, a semi-automatic mode of operation and a fully automatic mode of operation. To operate the pump in the fully manual mode of operation, the operator manually inputs in any order both a desired percent stroke volume and a stroke rate. After the parameters have been inputted, the microprocessor 68 then calculates the stroke length and the flow rate corresponding to the inputted parameters and thereafter controls the pump in accordance with the calculated parameters.

To operate the pump according to the present invention in a semi-automatic mode, the operator manually inputs the desired flow rate and either a desired percent stroke volume or stroke rate via the keypad 80 and then the microprocessor 68 calculates the necessary parameters (i.e., stroke length and, if not inputted by the user, stroke rate) corresponding to the inputted parameters. The pump is thereafter operated in accordance with the inputted or calculated stroke length and stroke rate.

To operate the pump according to the present invention in a fully automatic mode, the operator manually inputs the desired flow rate via the keypad 80 and then the microprocessor 68 determines both stroke rate and stroke length and operates the pump according to the determined parameters.

If one of the foregoing programming modes of operation is not selected by the user, the pump operates according to either the parameters previously programmed or the default parameters if no parameters had been previously programmed.

For all modes of operation, the inputted parameters as well as the calculated or determined parameters are shown on the display 82.

By controlling the power applied to the coil 28, the microprocessor 68 is able to electronically control the stroke length of the pump 20. In other words, once the desired parameters are inputted via the keypad 80, or set to default values, the microprocessor 68 instructs the driver circuit 72 to apply an amount of power to the coil 28 during the suction stroke thereby slowing down the stroke rate and stopping the armature 30 at the programmed or default stroke length. The armature 30 then hovers or remains stopped at the programmed or default stroke length for a period of time.

After the armature 30 hovers at the programmed or default stroke length, power is again applied to the coil 28 to begin a discharge stroke. During the discharge stroke, power to the coil is applied as a function of the position of the armature 30. Advantageously, only the amount of power needed to complete the discharge stroke is applied to the coil 28 so that force and energy are not wasted and so that the mechanical parts within the pump are not subjected to undue wear resulting from the application of excess force during pump stroking.

Figure 6A:
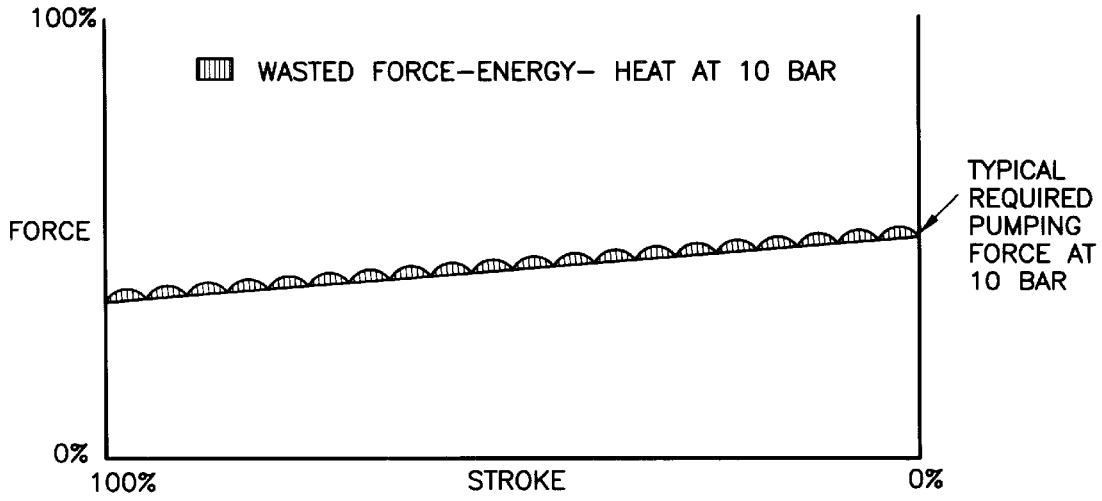
FIGS. 6A and 6B are idealized graphs similar to FIGS. 1 and 2 illustrating armature force as a function of armature position for the pump of FIGS. 4 and 5.
Figure 6B:
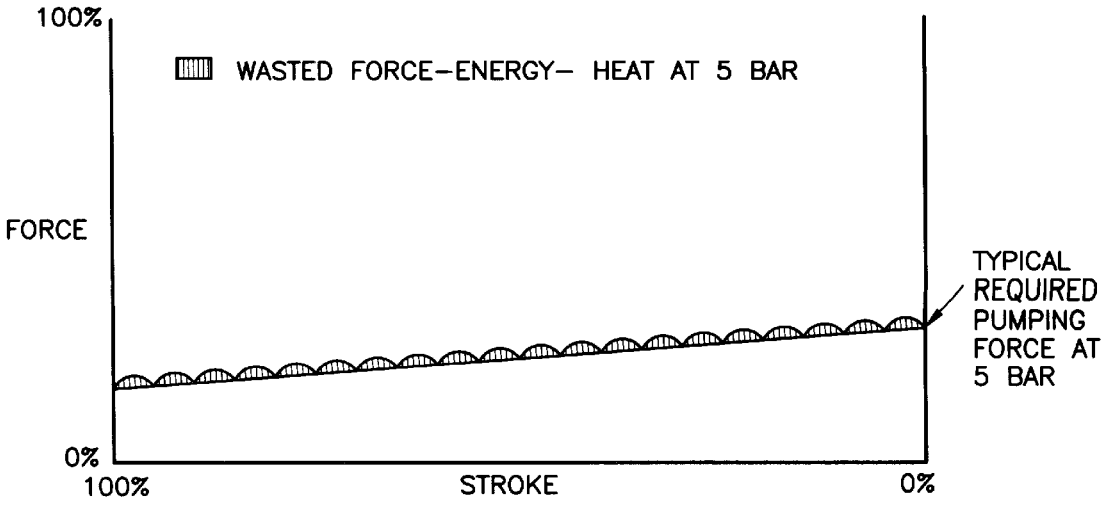

FIGS. 6A and 6B illustrate the tracking of developed EPU force during a discharge stroke with system pressure as a function of armature position for the pump of FIGS. 4 and 5. It can be seen that relatively little power is wasted during the discharge stroke, and hence, noise is reduced (because the armature does not slam into the pole piece 32 at the end of the stroke) as are generated heat levels.

In addition to electronically controlling the stroke length, the control of the present invention also automatically detects a loss of prime and, when such condition is detected, the control primes the pump and resumes the pump to normal operating conditions after the pump is primed or after a predetermined time following the detection of loss of prime. During normal operating conditions of the pump, an excess amount of air may be detected in the pump, indicating a lack of prime. The pump detects the presence of air or gas in the pump by detecting a stroke velocity greater than a certain programmed magnitude. The position sensor 60 senses the position of the armature 30 and the processor 68 calculates the change in position as a function of time, thereby determining the stroke velocity and detecting an increase thereof.

After the pump detects a loss of prime by sensing a stroke velocity greater than the programmed level, the processor 68 controls the power applied by the driver circuit 72 to the coil 28 during one or more subsequent suction strokes to stop the armature 30 near or at a maximum electrical stroke length position, thereby preventing the armature 30 from contacting the mechanical stop 39 (and causing wear thereof) shown in FIGS. 4 and 5. After the armature 30 is stopped at or near the maximum electrical stroke length position, the pulser circuit applies power to the coil 28, thereby increasing the stroking rate of the armature 30 to a maximum during one or more subsequent discharge strokes. This operation continues during subsequent suction and discharge strokes until the pump is again filled with liquid. At this point, the microprocessor 68 detects a reduction of stroke velocity below a certain level (indicating that the pump has been primed) and the microprocessor 68 reverts to the pump settings that were in effect at time that the loss of prime condition was detected. This resumption to previous pump settings is alternatively preferably effected at a predetermined time following detection of loss of prime regardless of whether the microprocessor 68 senses the reduction of stroke velocity below the certain level. Thus, the previous pump settings will be resumed after the predetermined time in case the supply of liquid for the pump is depleted.

Figure 7:
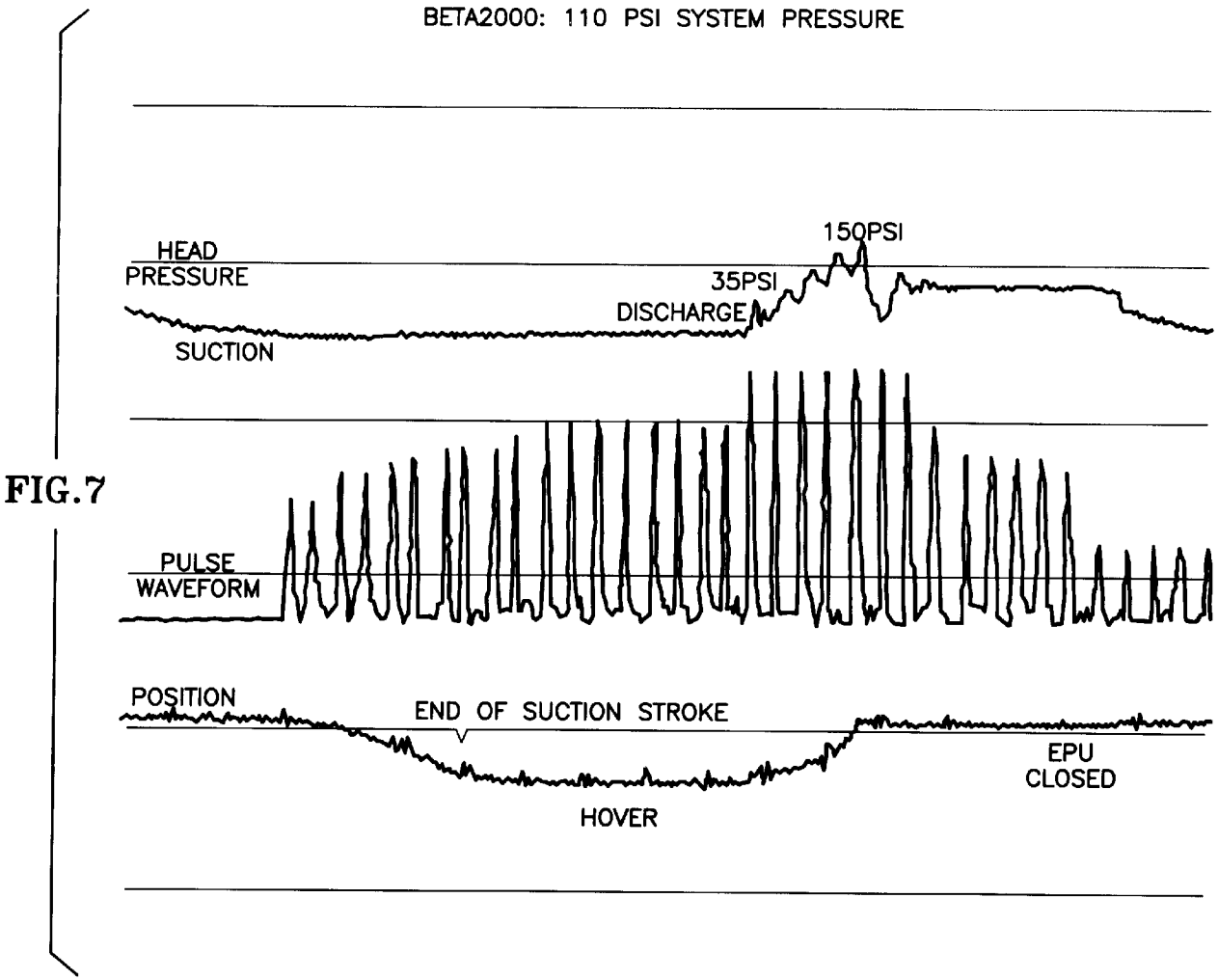
FIGS. 7 and 8 are waveform diagrams illustrating head pressure, armature position and applied pulse waveform at 110 psi and 30 psi system pressure, respectively, for the pump illustrated in FIGS. 4 and 5.
Figure 8:
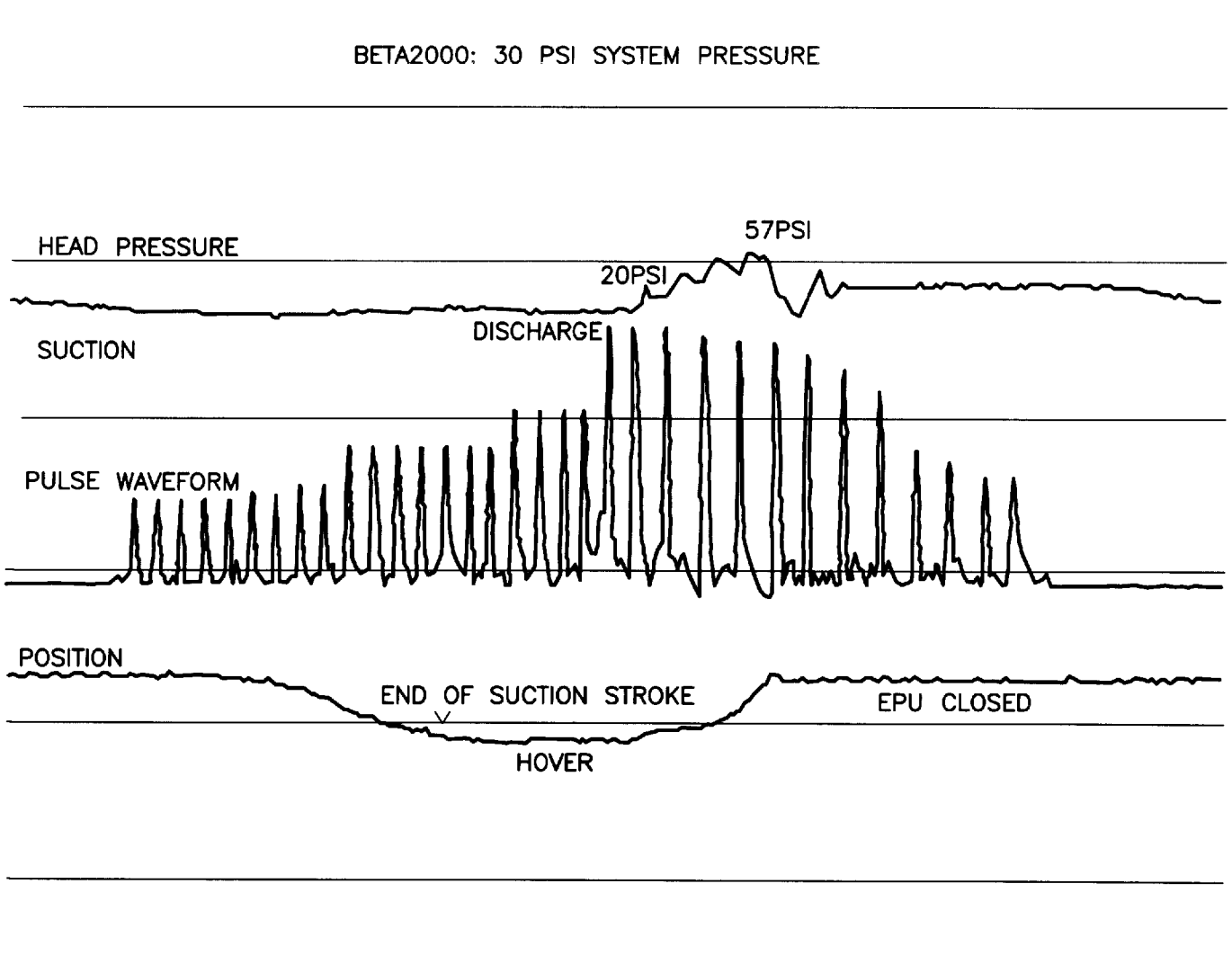

FIGS. 7 and 8 illustrate the operation of the present invention during both suction and discharge strokes at 110 psi system pressure and 30 psi system pressure, respectively (the system pressure is the liquid pressure at the point of injection of a liquid delivered by the pump 20 into a conduit containing a further pressurized liquid). As illustrated by each of the waveform diagrams of FIGS. 7 and 8, half-wave rectified pulses are appropriately phase controlled (i.e., either a full half-wave cycle or a controllably adjustable portion of a half-wave cycle) and are applied to the coil 28 during the discharge stroke as a function of the position of the armature 30 (as detected by the sensor 60) so that only enough power is supplied to the coil 28 to move the armature 30 the entire stroke length without wasting significant amounts of force and energy and generating significant amounts of heat. Appropriately phase controlled half-wave rectified pulses are also applied to the coil 28 during the suction stroke as a function of the position of the armature 30 (as also detected by the sensor) to electronically control the stroke length.

In the waveform diagrams of FIG. 7, the head pressure (i.e., the fluid pressure to which the diaphragm 46 is exposed) varies between 35 psi and 150 psi during the discharge stroke (i.e., during movement of the armature 30 and the diaphragm 46 between the position shown in FIG. 4 and the position shown in FIG. 5.) No fluid is discharged until the head pressure is greater than the system pressure. In other words, although the discharge stroke begins when the head pressure is approximately 35 psi, fluid is not discharged until the head pressure exceeds the system pressure of 110 psi. During the suction stroke, the head pressure remains substantially constant.

In the case of the waveform diagrams of FIG. 8, the head pressure varies between 20 psi and 57 psi as the armature 30 moves over the stroke length during a discharge stroke. As in FIG. 7, no fluid is discharged until the head pressure is greater than the system pressure. In other words, although the discharge stroke begins when the head pressure is approximately 20 psi, fluid is not discharged until the head pressure is greater than 30 psi. Again, the head pressure remains substantially constant during the suction stroke.

In both FIGS. 7 and 8, power is initially removed from the coil 28 at the beginning of the suction stroke and, after a short delay, the armature 30 begins moving toward a retracted position under the influence of the return springs 34. Phase-controlled half-wave pulses are then applied to the coil 28 to decelerate and stop the armature 30 at a certain position corresponding to the commanded stroke length. Appropriately phase-controlled half-wave pulses are then applied to the coil 28 to cause the armature 30 to "hover" at the certain position for a predetermined time interval. Half-wave rectified sinusoidal pulses are then applied to the coil 28 to begin the discharge stroke wherein the pulses are phase controlled to obtain pulse widths that result in a condition just short of or just at saturation of the EPU 26. Thus, the armature 30 is accelerated as quickly as possible toward an extended position (also referred to as a "bottomed out" position) without excess heat generation and dissipation. Thereafter, narrower pulses are applied during the discharge stroke as the armature 30 moves toward the bottomed out position. After such position is reached at the end of the discharge stroke, power is removed from the coil 28 and, after a short delay, the armature 30 begins moving toward a retracted position under the influence of the return springs 34, thereby initiating the suction stroke of the next full pump cycle as noted above.

Referring again to FIG. 9, the EPU driver receives the AC power from a power supply unit 74, which also supplies power to the microprocessor 68, and a signal measurement interface circuit 76 that receives an output signal developed by the position sensor 60. The zero detect circuit 70 detects zero crossings in the AC waveforms and provides an interrupt signal to the microprocessor 68 for purposes hereinafter described.

The microprocessor 68 is suitably programmed to execute several control routines, portions of which are illustrated in FIGS. 10A–10G. The main control routines of the present invention include programming for electronically controlling the stroke length of the armature 30 and for automatically and electronically priming and repriming the pump (FIGS. 10C–10G). Each control routine includes programming for applying power to the solenoid as a function of the position of the armature 30.

Figure 10A:
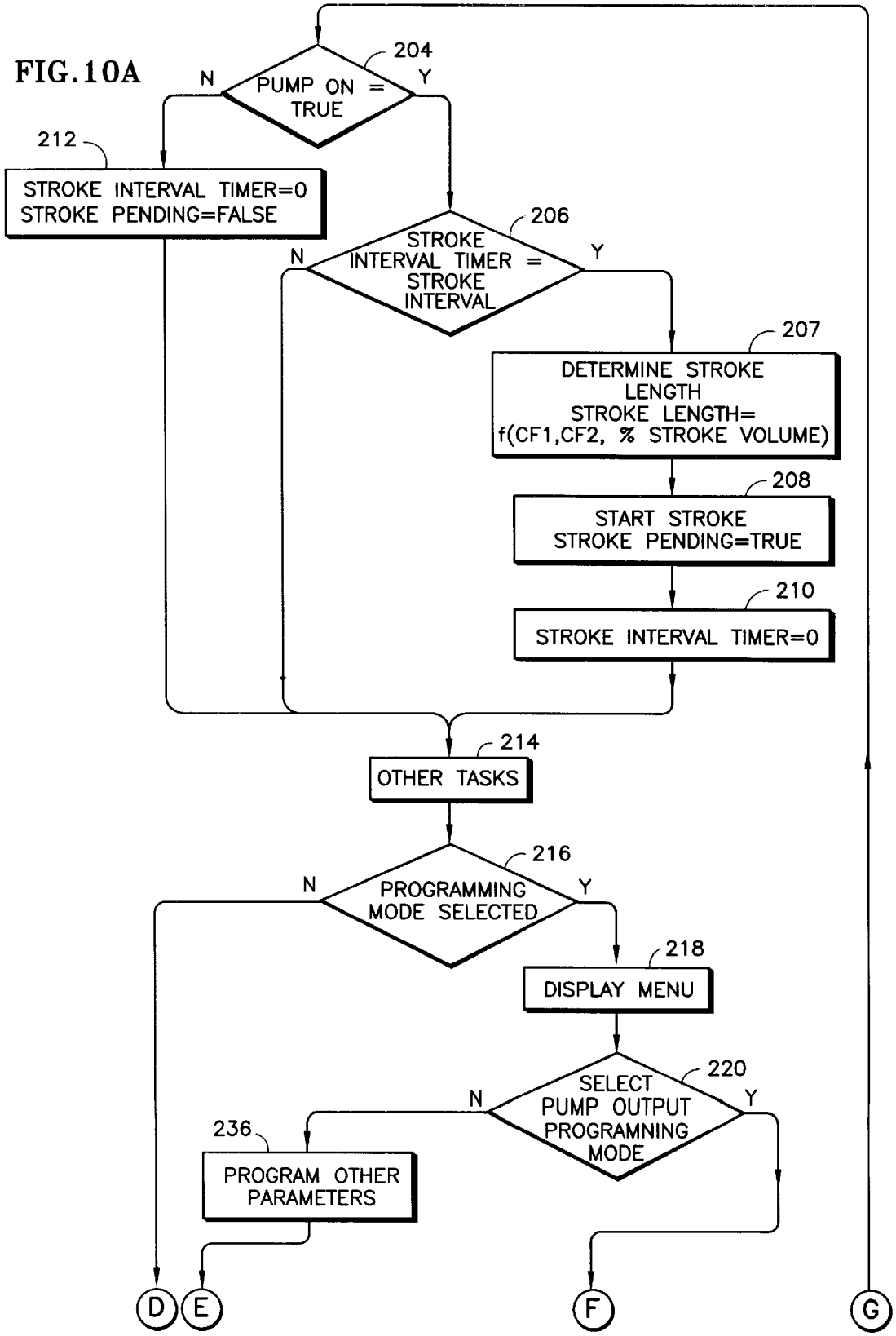
FIGS. 10A and 10B, when joined along the similarly lettered lines, together comprise a flowchart of a portion of the programming continuously executed by the microprocessor of FIG. 9 to implement the present invention.
Figure 10B:
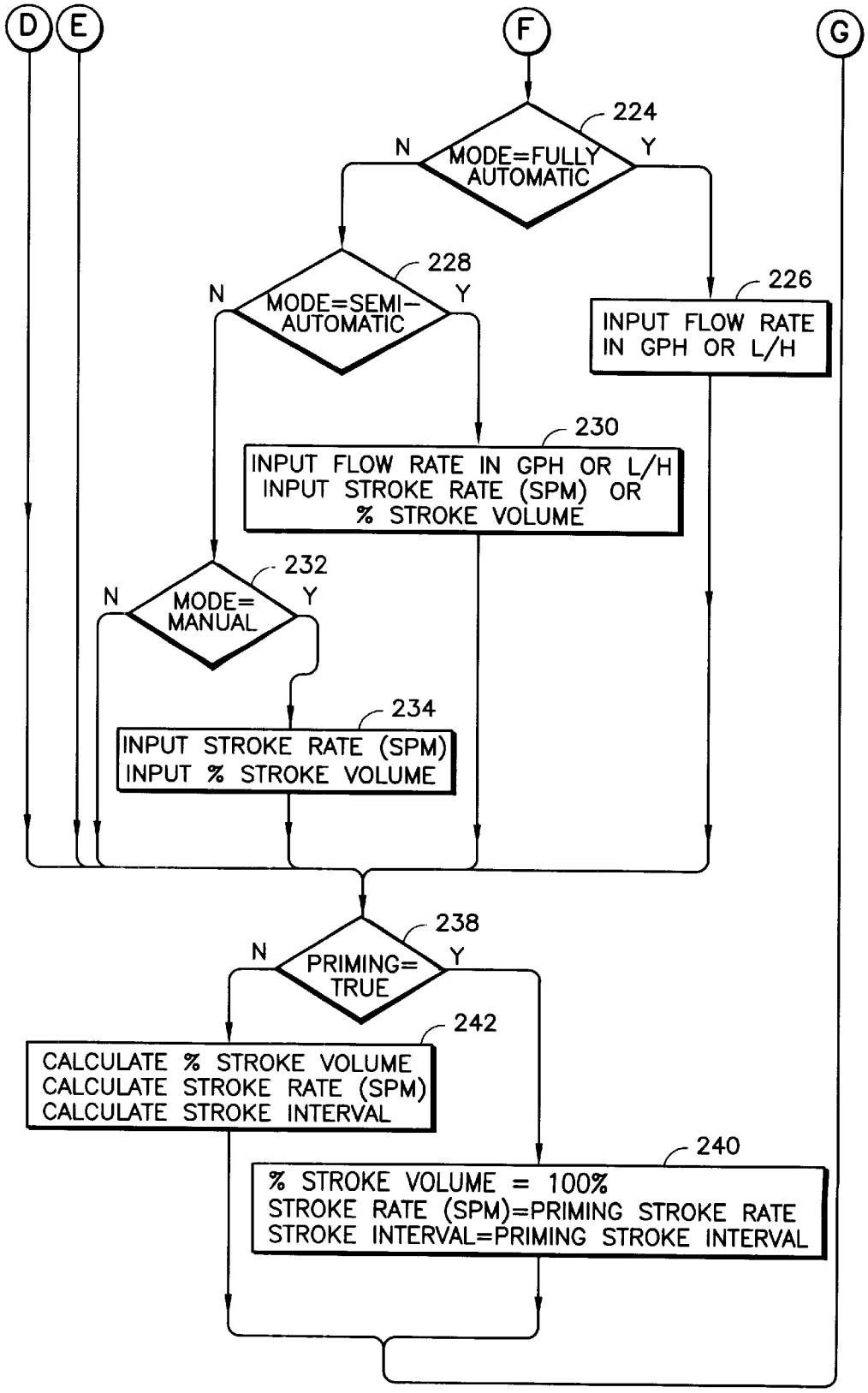

The programming of FIGS. 10A and 10B is continuously executed, but is periodically paused in response to generation of an interrupt signal to allow execution of the programming of FIGS. 10C–10G. This programming of FIGS. 10A and 10B includes commands for prompting a user to input one or more operational parameters for the pump. Referring now to FIG. 10A, a block 204 checks to determine whether a pump-on flag has been set indicating that the pump is currently on (a user may press a start/stop key of the keypad 80 to set or clear the pump-on flag). If this is true, a block 206 determines whether a stroke interval timer equals a parameter referred to as "stroke interval." The stroke interval represents the period of a full pumping cycle. During the first pass through the programming, the stroke interval is set equal to a default value and thereafter the stroke interval is determined by blocks 240 and 242 of FIG. 10B. The stroke interval timer begins timing at the end of a discharge stroke. When the stroke interval timer equals the stroke interval, a block 207 determines the stroke length for the next stroke cycle. The block 207 calculates the stroke length corresponding to the percent stroke volume using the correction factors CF1 and CF2. The correction factor CF1 is dependent upon the particular pump model and is empirically determined and factory programmed. The correction factor CF2 is obtained in the fashion noted hereinafter in connection with FIG. 10E.

After the stroke length has been determined, a block 208 sets a flag indicating that a stroke is pending. A block 210 then resets the stroke interval timer to zero.

If the block 204 determines that the pump is not on, a block 212 resets the stroke interval timer to zero and maintains the timer at such a value until the pump-on flag is set. Control from the blocks 210 and 212 passes to a block 214. The block 214 commands the system to accomplish other tasks that include updating the display, monitoring keypad inputs, monitoring system inputs and updating memory.

Following the block 214, a block 216 determines whether a programming mode of operation has been selected. If not, control immediately passes to a block 238, FIG. 10B. Otherwise, a block 218 (FIG. 10A) causes the display 82 to display a menu prompting a user, among other things, to indicate whether programming of the pump is desired. A block 220 then determines whether the user has selected a pump programming mode of operation. If so, control passes to a block 224, FIG. 10B.

Figure 10C:
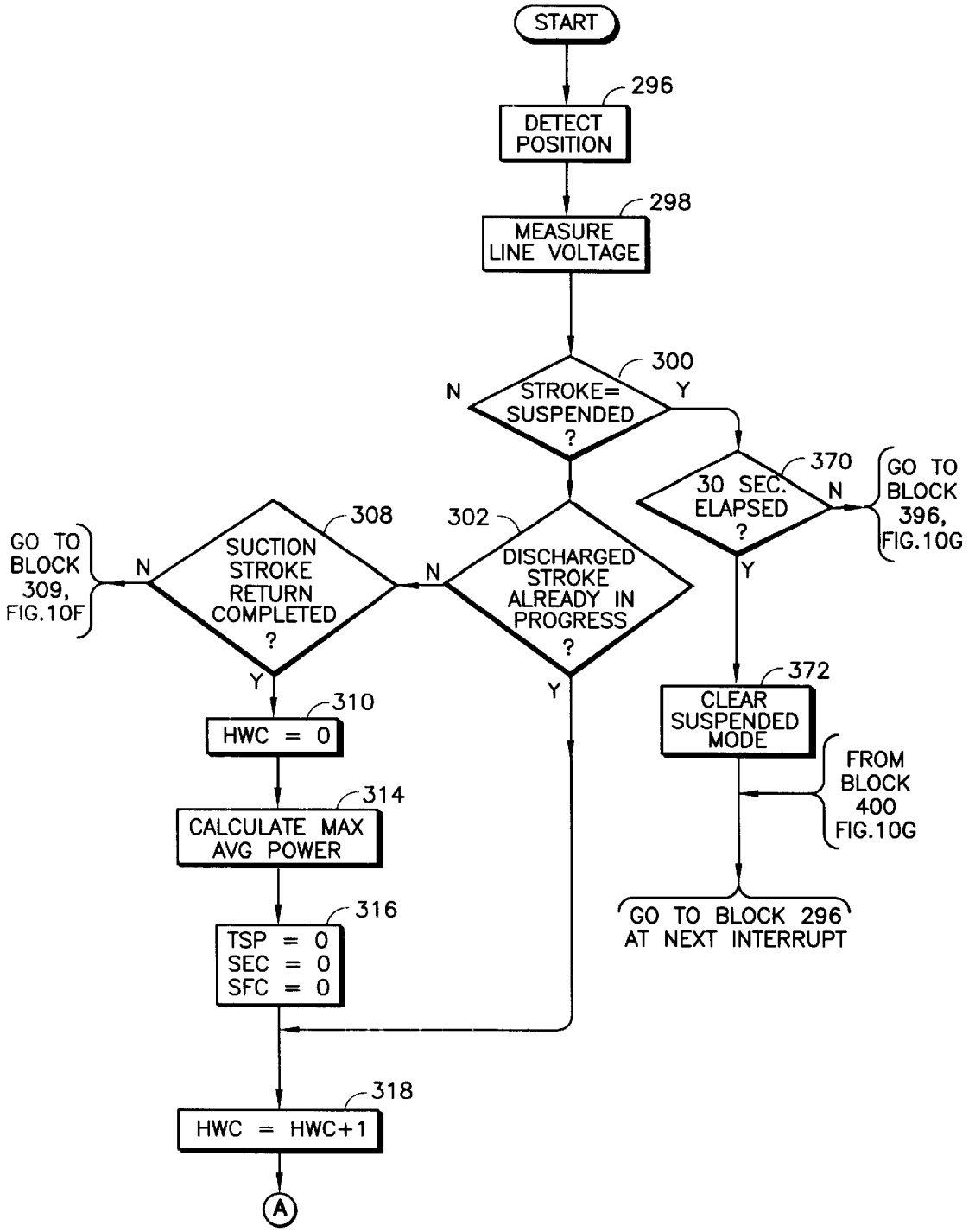
FIGS. 10C–10G, when joined along the similarly lettered lines, together comprise a flowchart of a portion of programming executed by the microprocessor of FIG. 9 to implement the present invention.
Figure 10D:
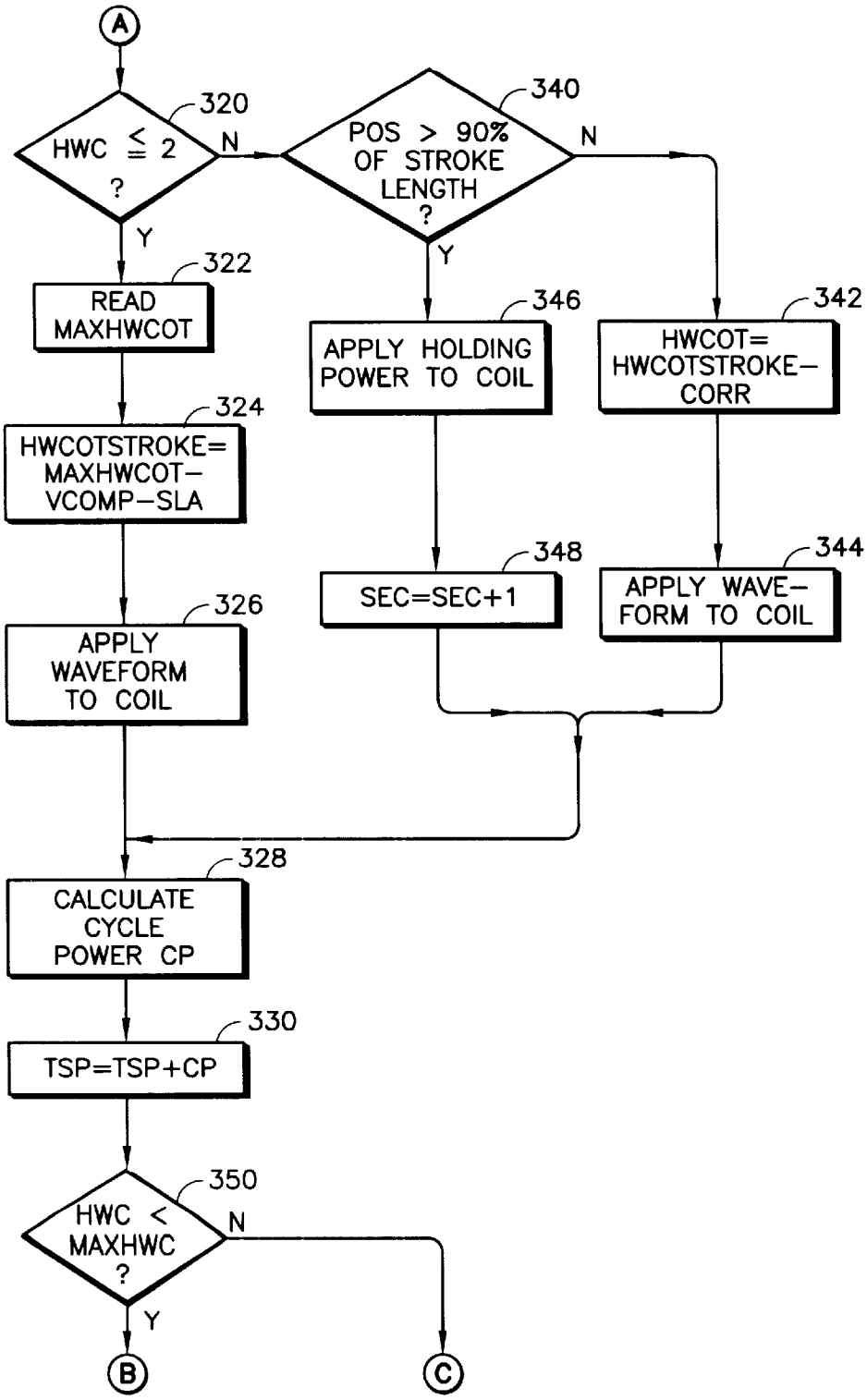
Figure 10E:
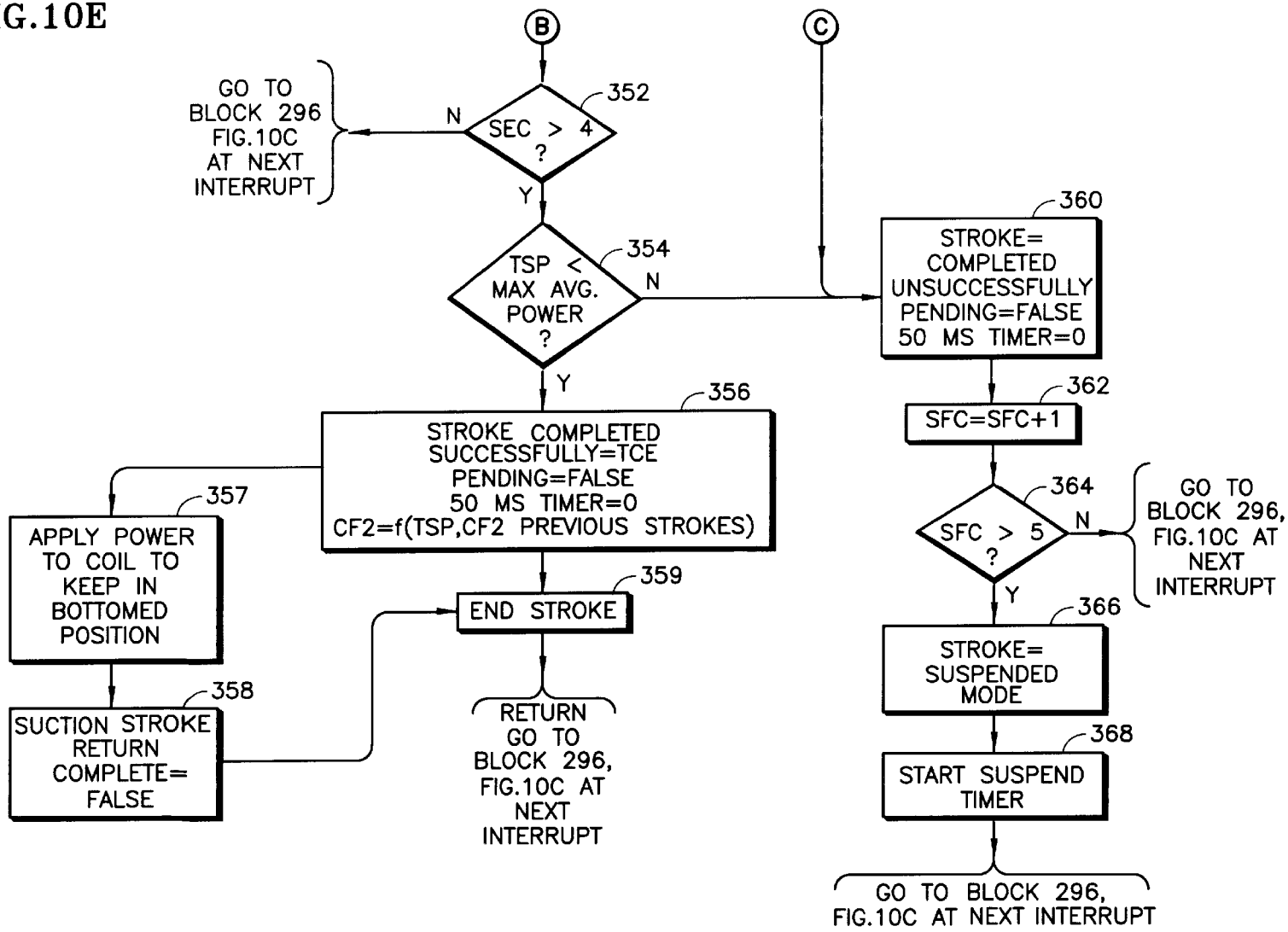
Figure 10F:
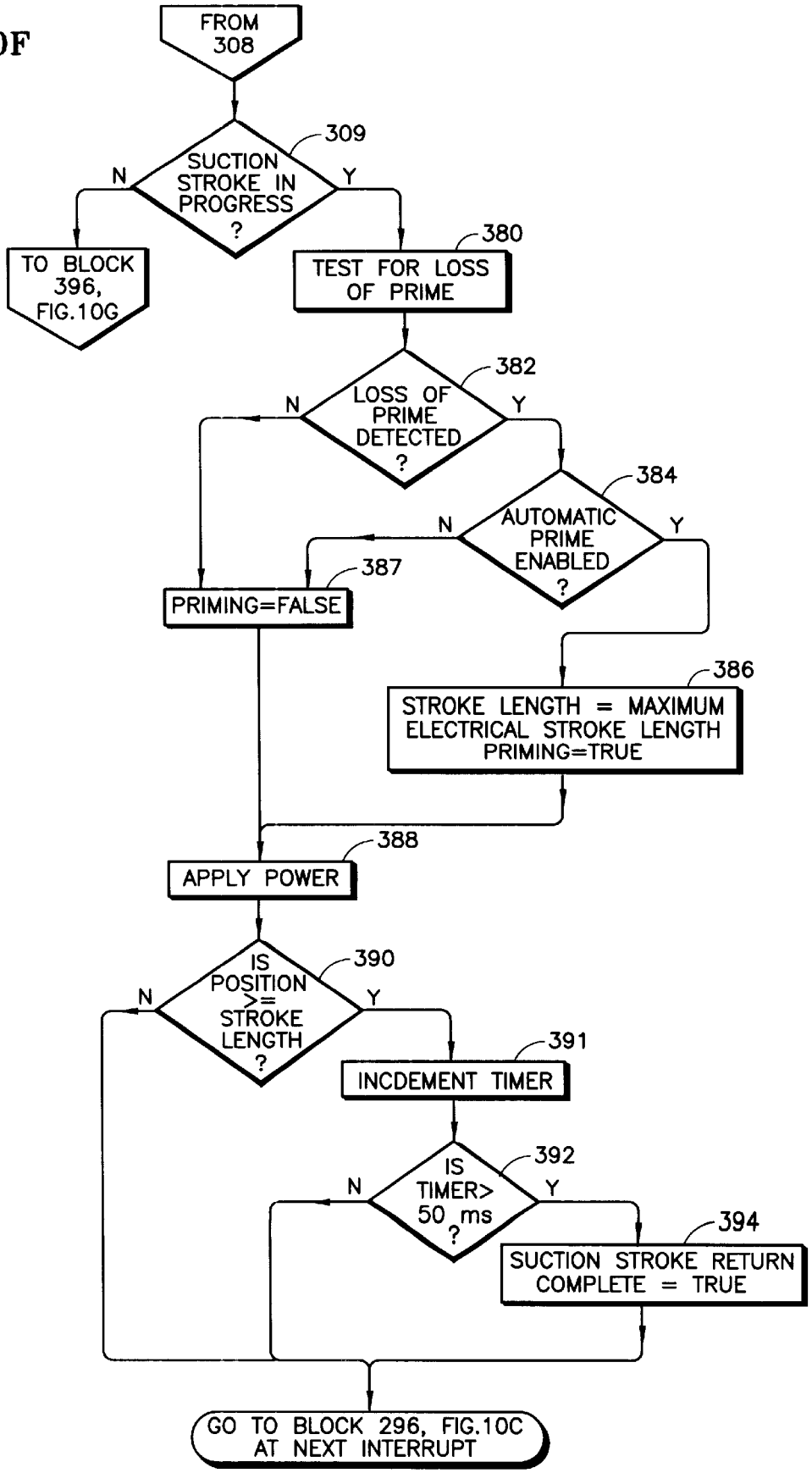
Figure 10G:
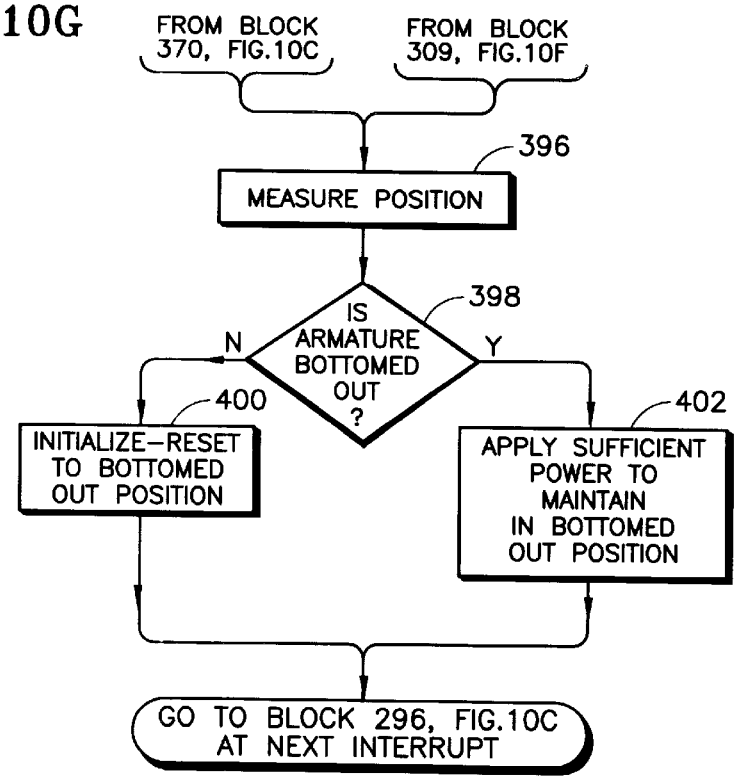

Referring now to FIG. 10G, the block 224 determines whether the user selected the fully automatic mode of operation. If this is the case, a block 226 prompts the user to input a flow rate and control then passes to the block 238. If the block 224 determines that the user did not select the fully automatic mode of operation, a block 228 determines whether the user selected the semi-automatic mode of operation. If so, a block 230 prompts the user to input both a desired flow rate and one of either a desired stroke rate or a desired percent stroke volume. After the user inputs the desired parameters, control passes to the block 238.

If the block 228 determines that the user did not select the semi-automatic mode of operation, a block 232 determines whether the user selected the manual mode of operation. If so, a block 234 prompts the user to input both a desired stroke rate and a desired percent stroke volume and control then passes to the block 238. Control also passes directly to the block 238 (bypassing the block 234) if the block 232 determines that the user has not selected the manual mode. Thus, the block 232 provides the user an opportunity to exit the programming mode of operation even after indicating a desire to program the pump.

Once the pump mode of operation has been determined, the block 238 determines whether a flag has been set indicating that pump priming is to occur. If so, a block 240 sets the percent stroke volume to 100%, the stroke rate equal to a priming stroke rate and the stroke interval equal to a priming stroke interval. The priming stroke rate and the priming stroke interval are empirically-determined values which cause the armature to move at a sufficiently fast speed to accomplish priming of the pump. If desired, the user may alternatively establish values for the priming stroke rate and priming stroke interval. If the block 238 determines that priming is not to be accomplished, a block 242 calculates the percent stroke volume and/or the stroke rate and/or the stroke interval, depending upon the parameters inputted in the blocks 224–234 or the default pump parameters. Control from the blocks 240, 242 returns to the block 204, FIG. 10A.

Referring now to FIG. 10C, once the microprocessor 68 determines that the software illustrated by FIGS. 10C–10E is to be executed, a block 296 checks the output of the signal measurement circuit 76 to detect the position of the armature 30. A block 298 then operates the signal measurement interface circuit 76 to sense the magnitude of the AC voltage supplied by the power supply unit 74. Following the block 298, a block 300 checks to determine whether a flag internal to the microprocessor 68 has been set indicating that pumping has been suspended. If this is the case, control passes to a block 370 to determine whether 30 seconds have elapsed. If so, a block 372 clears or resets the suspended mode and control returns to the block 296 upon receipt of the next interrupt. If the block 370 determines that 30 seconds have not elapsed, control passes to a block 396, FIG. 10G.

If the block 300 determines that pumping has not been suspended, a block 302 checks to determine whether a discharge stroke of the armature 30 is already in progress. If a discharge stroke is not in progress, a block 308 checks to determine whether the armature has completed a suction stroke (i.e., whether the armature 30 has reached an end-of-stroke position). This is accomplished by checking the state of a flag denoted SUCTION STROKE RETURN COMPLETE. If the suction stroke return is not complete, control passes to a block 309, FIG. 10F. Otherwise, control passes to a block 310, which initializes a variable HWC (denoting half wave cycle number) to a value of zero.

Following the block 310, a block 314 calculates a maximum average power level APMAX which is not to be exceeded during a discharge stroke as follows:

$$APMAX = \frac{CPMAX * SPMMAX * SLAMAX}{SPM * SLA}$$

where CPMAX is a stored empirically-determined value representing the maximum continuous power per discharge stroke allowed at maximum stroke length (SLAMAX), maximum stroke rate (SPMMAX) and maximum pressure (SLAMAX and SPMMAX are stored as well) and where SPM is the stroke rate and SLA is the stroke length. The value of APMAX represents the maximum power to be applied to the coil 28 beyond which no further useful work will result during a discharge stroke (in fact, a deterioration in performance and heating will occur).

The block 314 also inherently accommodates an increase in power to the power unit during the discharge stroke for high viscous fluid conditions. In other words, the pump of the present invention is capable of automatically detecting a high viscous fluid condition (by sensing armature position and velocity) and can increase the power applied to the power unit during the discharge stroke to successfully complete the stroke during this fluid condition.

Thus, during a high viscous fluid condition, the maximum average power APMAX per discharge stroke may be increased up to an empirically-determined value that is greater than the maximum continuous power per discharge stroke CPMAX. In this case, the value of APMAX can be increased up to a level of, for example, 150% of CPMAX. In order to increase the maximum average power per stroke APMAX to such an increased value, the stroke rate SPM must be decreased to a level less than the maximum stroke rate SPMMAX. If the stroke rate SPM is not decreased to a level less than the maximum stroke rate SPMMAX, then the maximum average power APMAX per stroke during a high viscous fluid condition cannot exceed the default maximum continuous power CPMAX per stroke.

Following the block 314, a block 316 initializes variables TSP (denoting total stroke power during a discharge stroke), SEC (a stroke end counter which is incremented at the end of the discharge stroke) and SFC (a stroke fail counter which is incremented at the end of a failed discharge stroke) to zero.

Following the block 316, and following the block 302 if it has been determined that a discharge stroke is already in progress, a block 318 increments the value of HWC by one and control passes to a block 320, FIG. 10D. The block 320 checks to determine whether the value of HWC is less than or equal to three. If this is found to be true, control passes to a block 322 which reads a stored value MAXHWCOT and representing the maximum half wave cycle on time (i.e., the maximum half wave pulse width or duration). This value is dependent upon the frequency of the AC power supplied to the power supply unit 74.

A block 324 then establishes the value of a variable HWCOTSTROKE (denoting half wave cycle on time for this discharge stroke) at a value equal to MAXHWCOT less a voltage compensation term VCOMP and less a stroke length adjustment term SLA. It should be noted that either or both of VCOMP and SLA may be calculated or determined in accordance with empirically-derived data and/or may be dependent upon a parameter. For example, each of a number of positive and/or negative empirically-determined values of VCOMP may be stored in a look-up table at an address dependent upon the value of the AC line voltage magnitude as sensed by the block 298 of FIG. 10C. The term SLA may be determined in accordance with the stroke length. Specifically, each of a number of empirically-determined values of SLA may be stored in a look-up table at an address dependent upon the stroke length. Following the block 324, a block 326 then operates the EPU driver circuit 72 so that an appropriately phase controlled half-wave rectified pulse of duration determined by the current value of HWCOTSTROKE is applied to the coil 28.

Thereafter, a block 328 calculates the total power applied to the coil 28 by the block 326 and a block 330 accumulates a value TSP representing the total power applied to the coil 28 over the entire discharge stroke. The value TSP is equal to the accumulated power of the previous pulses applied to the coil 28 during the current discharge stroke as well as the power applied by the block 326 in the current pass through the programming.

If the block 320 determines that the value of HWC is greater than 3, a block 340 checks to determine whether the position of the armature 30 is greater than 90° of the total stroke length (in other words, the block 340 checks to determine whether the armature 30 has traveled more than 90% of the calculated stroke length during the current discharge stroke). If this is not true, the value HWCOT is calculated by a block 342 as follows:

HWCOT=HWCOTSTROKE−CORR

Each of a number of values for the term CORR in the above equation may be stored in a look-up table at an address dependent upon the distance traveled by the armature 30 since the last cycle, the current position of the armature 30 as well as the current value of HWC (i.e., the number of half-waves that have been applied to the coil 28 during the current stroke). The function of the block 342 is to reduce the power applied during each cycle as the stroke progresses. Thereafter, a block 344 operates the driver 72 to apply a half-wave rectified pulse, appropriately phase controlled in accordance with the value of HWCOT, to the coil 28. Following the block 344, control passes to the block 328.

If the block 340 determines that the position of the armature 30 is within 10% of the desired or calculated stroke length, a block 346 controls the EPU driver 72 to apply a voltage to the coil 28 sufficient to hold the coil at the stroke length for a selected period of time, such as 50 milliseconds, determined by the stroke end counter SEC. Preferably, this voltage is selected to provide just enough holding force to keep the armature 30 at the end of travel limit but is not so high as to result in a significant amount of wasted power. Following the block 346, a block 148 increments the stroke end counter SEC by one and control passes to the block 328.

Once the current cycle power and the total stroke power have been calculated by the blocks 328 and 330, a lock 350 checks to determine whether the value of HWC is less than or equal to a maximum half-wave cycle value MAXHWC stored by the microprocessor 68. If this is true, control passes to a block 352, FIG. 10E, which checks to determine whether the current value stored in the stroke end counter SEC is greater than or equal to 4. If this is not true, control returns to the block 296 of FIG. 10C upon receipt of the next interrupt. On the other hand, if SEC is greater than or equal to 4, control passes to a block 354 which checks to determine whether the current calculated total stroke power TSP is less than or equal to the maximum average power calculated by the block 314 of FIG. 10C. If this is also true, a flag is set by a block 356 indicating that the current stroke has been successfully completed. The block 356 also resets the stroke pending flag, initializes a 50 millisecond timer to zero and updates the second correction factor CF2. The factor CF2 is updated based on the value of TSP calculated during the current stroke, the total discharge stroke time and previous values of CF2 as calculated by the block 356 during previous passes of the program. It can be seen that CF2 is updated at the end of each successful stroke and, as noted above, the value thereof is used by the block 207 of FIG. 11A to determine the stroke length.

A block 357 then applies power to the coil 28 to keep the armature 30 in the bottomed out position. This is accomplished by executing the software represented in detail in FIG. 10G (which is described in greater detail below). A block 358 then resets the flag indicating that the suction stroke return has been completed and a block 359 ends the stroke.

If the block 354 determines that the total stroke power exceeds the value of the maximum average power calculated by the block 314, a block 360 sets a flag indicating that the current stroke has been completed unsuccessfully, and resets a flag indicating that a discharge stroke is not pending. The block 360 further initializes the 50 millisecond timer to zero. A block 362 then increments the stroke fail counter by 1 and a block 364 checks to determine whether the stroke fail counter SFC has a current value greater than 5. If this is true, a flag is set by a block 366 indicating that the current discharge stroke has been placed in the suspended mode and a block 368 starts a timer which is operable to maintain the suspended mode flag for a certain period of time, for example 30 seconds. Control then returns at receipt of the next interrupt to the block 296, FIG. 10C, following which a block 370 checks to determine whether the 30 second timer has expired. Once this occurs, a block 372 clears or resets the suspended mode flag.

Following the block 372, or following the block 370 if the 30 second timer has not expired, control returns to the block 296, FIG. 10C, upon receipt of the next interrupt.

If the block 364 determines that the current value of the stroke fail counter SFC is not greater than 5, control passes at receipt of the next interrupt to the block 296 of FIG. 10C.

As should be evident, the effect of the foregoing programming during each discharge stroke is initially to apply two half-wave rectified pulses phase controlled in accordance with the value of VCOMP and SLA to the coil 28 and thereafter apply half-wave rectified, phase controlled pulses until the 90% stroke length limit is reached. It should be noted that the pump may alternatively be programmed so that three half-wave rectified pulses (also phase controlled in accordance with the value of VCOMP and SLA) are initially applied to the coil 28. In general, the pulse widths are decreased during this interval until the 90% point is reached and thereafter the holding power is applied to the coil 28.

As pulses are applied to the coil 28, the power applied to the coil during the stroke is accumulated and, if the power level exceeds the maximum average power level, a conclusion is made that the stroke has been completed unsuccessfully. If five or more strokes are unsuccessfully completed, further operation of the pump 20 is suspended for 30 seconds.

The main control routine for electronically controlling the stroke length and automatically and electronically priming and repriming the pump when necessary is illustrated in FIG. 10F. The programming of FIG. 10F is undertaken if the block 308 of FIG. 10C determines that the current suction stroke return is not complete.

If the suction stroke is not complete, the block 309 determines whether a suction stroke is in progress by checking whether the STROKE PENDING flag has been set by the block 208 (FIG. 10A). If not, control passes to a block 396, FIG. 10G. On the other hand, if the stroke is pending, block 380 tests whether a loss of prime has occurred in the pump by measuring the stroke velocity or the speed of the armature 30 during a return or suction stroke. A block 382 then determines whether a loss of prime has been detected during the suction stroke. If a loss of prime has been detected, a block 384 determines whether automatic priming has been enabled. If automatic priming has been enabled, a block 386 establishes the stroke length at the maximum electrical value and sets a flag indicating the pump is priming. A block 388 then applies power to the coil 28 to stop the armature 30 at the maximum electrical stroke length before it hits the mechanical stop 39 shown in FIGS. 4 and 5. If either the block 382 determines that a loss of prime has not been detected or if the block 384 determines that the automatic priming has not been enabled, control passes to a block 387 which resets a flag indicating the pump is not priming. Control then passes to the block 388, where power is applied to the coil 28 during the suction stroke to control the stroke length according to the inputted, calculated or default parameters. The power applied to the coil during the suction stroke is at a level which allows the return springs 34 to retract the armature 30 at a controlled speed.

Following the block 388, a block 390 then checks to determine whether the armature 30 has moved a distance greater than or equal to the stroke length. If this is not true, control returns to the block 296, FIG. 10C, when the next interrupt is received. Alternatively, if the block 390 determines that the armature 30 has moved a distance greater than or equal to the stroke length, a block 391 increments an end-of-suction stroke timer. A block 392 then checks this timer to determine whether a predetermined time period of, for example, 50 milliseconds has elapsed from the time that the position of the armature 30 first equaled or exceeded the stroke length. This time period is provided to allow a valve ball 385 of the first check valve 52 to drop down and close against a seat of the valve 52. If the predetermined time period has elapsed, a block 394 sets a flag indicating that a suction stroke has been completed and control passes to the block 296, FIG. 10C, upon receipt of the next interrupt. If this predetermined time period has not elapsed, control then bypasses the block 394.

FIG. 10G illustrates portions of the control routine when pumping has been suspended or during the stroke interval time (i.e., the time between successive stroke cycles) for the electromagnetic metering pump of the present invention. Once it has been determined by the block 370 of FIG. 10C or once the block 309 of FIG. 10F has determined that a suction stroke is not pending, control passes to block 396, FIG. 10G, which measures the position of the armature 30. A block 398 then checks to determine whether the armature 30 is in the bottomed out or fully extended position. If a block 400 initializes or resets the armature to the bottomed out position, if the armature is in the bottomed out position, a block 402 applies sufficient power to the coil 28 to maintain the armature at such position. Control from the blocks 400 and 402 then passes to the block 296, FIG. 10C, when the next interrupt is received.

The present invention obtains important advantages over other pumps:

1. The present pump can implement an automatic, electronic stroke adjustment control, thereby obviating the need for a stroke adjustment knob or other mechanical stroke adjustment control.

2. The present pump can automatically detect a loss-of-prime condition and provides an automatic priming control, thereby obviating the need for a priming button or other priming device.

3. The pump utilizes less power than other pumps of comparable rating because it applies power as a function of the armature position.

4. The pump is quieter than comparable conventional electromagnetic pumps because of less banging by the armature 30 at the end of the stroke owing to the reduction in power (the application of power as a function of armature velocity and position) as the armature 30 is about to contact the pole piece 32. Accuracy is also improved because there is less fluid inertia at the end of the discharge stroke which otherwise could result in overpumping, especially under certain circumstances.

5. The present control methodology results in a longer pump life owing to the reduction in stress on the various components. Accuracy is also improved because the stroke length will have a lesser tendency to grow with time. In addition, heat, and hence thermal expansion, are reduced and return springs can be made less stiff, thereby resulting in lower stresses.

6. A pump incorporating the present invention can pump more viscous materials when the material is at a pressure less than full pressure rating. The software automatically detects a high viscous fluid condition owing to the detection of armature position with respect to time and increases the power up to 50% to force the viscous fluid through the liquid end 24. This also contributes to accuracy owing to the ability to complete the stroke even if the chemical becomes viscous only temporarily.

7. A pump incorporating the present invention can be used at higher than rated voltage without overheating owing to the ability to phase back (i.e., reduce) the power applied to the coil as required. This also means that a pump incorporating the present invention does not require different coils for different voltage ratings.

8. A pump utilizing the present invention is externally programmable in the sense that pumping characteristics can be changed by changing the programming of the microprocessor.

As noted previously, the present invention is not limited to use with an electromagnetic metering pump. The present control could instead be used to operate a control element of a hydraulic metering pump, or any other suitable device, as desired.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights of all modifications which come within the scope of the appended claims are reserved.

What is claimed is:

1. A control for a metering pump having a movable pump element, the movable pump element being movable over a stroke length which is controllably variable in response to electrical power applied to a power unit, comprising:

a sensor for detecting the velocity of the movable pump element; and a circuit responsive to the sensor and modulating electrical power applied to the power unit in dependence upon the detected velocity of the movable pump element to automatically prime the pump.

2. The control of claim 1, wherein the power unit comprises a solenoid.

3. The control of claim 2, wherein the solenoid comprises a coil.

4. The control of claim 1, wherein the pump element comprises an armature.

5. The control of claim 4, wherein the sensor comprises a position sensor for detecting armature position.

6. The control of claim 3, wherein the circuit comprises a driver circuit that is coupled to the coil for applying electrical power thereto.

7. The control of claim 4, further comprising a programmed processor responsive to the sensor for controlling the circuit and wherein the circuit modulates electrical power delivered to the power unit in dependence upon a position of the armature.

8. The control of claim 7, wherein the circuit increases the power delivered to the power unit during a discharge stroke in response to a high viscous fluid condition.

9. The control of claim 1, wherein the pump comprises an electromagnetic metering pump.

10. The control of claim 1, wherein the pump comprises a hydraulic metering pump.

11. The control of claim 1, wherein the pump element is alternately movable in suction and discharge strokes and wherein the circuit includes means for increasing power applied to the power unit during a suction stroke when the detected pump element velocity is greater than a certain magnitude and means for reapplying power to the power unit during a subsequent discharge stroke to prime the pump.

12. The control of claim 11, wherein the pump has a mechanical stop and wherein the circuit increases the amount of power applied to the power unit to prevent the pump element from contacting the mechanical stop.

13. The control of claim 11, wherein the circuit includes means for returning the pump to a set of programmed parameters after the pump is primed.

14. The control of claim 11, wherein the circuit includes means for returning the pump to a set of programmed parameters once a particular priming period has expired.

15. The control of claim 14, wherein the returning means comprises a timer and means for establishing the set of programmed parameters.

16. A control for a metering pump having a movable pump element, the movable pump element being movable over a stroke length which is controllably variable in response to electrical power applied to a solenoid, comprising:

a position sensor for detecting a position of the pump element; and a driver circuit responsive to the sensor and modulating electrical power applied to the solenoid in dependence upon the position of the pump element to automatically prime the pump;

wherein the pump element is alternately movable in suction and discharge strokes and wherein the circuit includes means for increasing power applied to the power unit during a suction stroke when a detected pump element velocity is greater than a certain magnitude and means for reapplying power to the power unit during a subsequent discharge stroke to prime the pump.

17. The control of claim 16, wherein the solenoid comprises a coil.

18. The control of claim 16, wherein the pumping element comprises a movable armature.

19. The control of claim 18, wherein the position sensor detects the position of the armature.

20. The control of claim 17, wherein the driver circuit is coupled to the coil for applying electrical power thereto.

21. The control of claim 18, further comprising a programmed processor responsive to the sensor for controlling the driver circuit and wherein the circuit modulates electrical power delivered to the solenoid in dependence upon the position of the armature.

22. The control of claim 21, wherein the circuit increases the power delivered to the solenoid during a discharge stroke in response to a high viscous fluid condition.

23. The control of claim 16, wherein the metering pump comprises an electromagnetic metering pump.

24. The control of claim 16, wherein the pump has a mechanical stop and wherein the circuit increases the amount of power applied to the power unit to prevent the pump element from contacting the mechanical stop.

25. The control of claim 16, wherein the circuit includes means for returning the pump to a set of programmed parameters after the pump is primed.

26. The control of claim 16, wherein the circuit includes means for returning the pump to a set of programmed parameters once a particular priming period has expired.

27. The control of claim 26, wherein the returning means comprises a timer and means for establishing the set of programmed parameters.

28. A method of automatically priming a pump having a coil and an armature movable within a range of positions, wherein the armature is movable in suction and discharge strokes, the method comprising the steps of:

detecting the position of the armature;

increasing electrical power applied to the coil during a suction stroke of the armature when the detected armature velocity is greater than a certain magnitude; and reapplying power to the coil during a subsequent discharge stroke to prime the pump.

29. The method of claim 28, wherein the pump has a mechanical stop and wherein the circuit increases the amount of power applied to the power unit to prevent the pump element from contacting the mechanical stop.

30. The method of claim 28, further comprising the step of returning the pump to a set of programmed parameters after the pump is primed.

31. The method of claim 28, further comprising the step of returning the pump to a set of programmed parameters once a particular priming period has expired.

32. The method of claim 28, further comprising the step of providing power to the coil during a discharge stroke in dependence upon the detected armature position.

33. A control for a metering pump having a movable pump element alternately movable in suction and discharge strokes, the movable pump element being movable over a stroke length which is controllably variable in response to electrical power applied to a power unit, comprising:

a sensor for detecting an operational characteristic of the pump; and a circuit responsive to the sensor and modulating electrical power applied to the power unit in dependence upon the detected operational characteristic of the pump element causing an increase in the stroke length to prime the pump.

34. The control of claim 33, wherein the power unit comprises a solenoid.

35. The control of claim 34, wherein the solenoid comprises a coil.

36. The control of claim 33, wherein the pumping element comprises a movable armature.

37. The control of claim 36, wherein the sensor comprises a position sensor for detecting the position of the armature.

38. The control of claim 35, wherein the circuit comprises a driver circuit that is coupled to the coil for delivering electrical power thereto.

39. The control of claim 38, wherein the circuit increases the power delivered to the coil during a discharge stroke in response to a high viscous fluid condition.

40. The control of claim 33, wherein the pump comprises an electromagnetic metering pump.

41. The control of claim 33, wherein the pump comprises a hydraulic metering pump.

42. The control of claim 33, wherein power is applied to the pump during a suction stroke for controlling the stroke length.

43. The control of claim 33, wherein the pump element is alternately movable in suction and discharge strokes and wherein the circuit includes means for increasing power applied to the power unit during a suction stroke when the detected pump element velocity is greater than a certain magnitude and means for reapplying power to the power unit during a subsequent discharge stroke to prime the pump.

44. The control of claim 43, wherein the pump has a mechanical stop and wherein the circuit increases the amount of power applied to the power unit to prevent the pump element from contacting the mechanical stop.

45. The control of claim 43, wherein the circuit includes means for returning the pump to a set of programmed parameters after the pump is primed.

46. The control of claim 43, wherein the circuit includes means for returning the pump to a set of programmed parameters once a particular priming period has expired.

47. The control of claim 46, wherein the returning means comprises a timer and means for establishing the set of programmed parameters.

* * * * *